US008622943B2

(12) United States Patent
Ben-Nun

(10) Patent No.: US 8,622,943 B2
(45) Date of Patent: Jan. 7, 2014

(54) COMPRESSION BAG

(75) Inventor: Asher Ben-Nun, Carmiel (IL)

(73) Assignee: Mego Afek AC Ltd., Doar Afek (IL)

( * ) Notice: Subject to any disclaimer, the term of this patent is extended or adjusted under 35 U.S.C. 154(b) by 359 days.

(21) Appl. No.: 12/903,433

(22) Filed: Oct. 13, 2010

(65) Prior Publication Data

US 2011/0098616 A1 Apr. 28, 2011

Related U.S. Application Data

(60) Provisional application No. 61/301,345, filed on Feb. 4, 2010.

(30) Foreign Application Priority Data

Oct. 13, 2009 (IL) ..... 201497

(51) Int. Cl.
*A61H 7/00* (2006.01)

(52) U.S. Cl.
USPC ..... 601/152; 601/148; 601/149; 601/151

(58) Field of Classification Search
USPC ..... 601/148–152; 602/13; 128/882
See application file for complete search history.

(56) References Cited

U.S. PATENT DOCUMENTS 2,267,070 A * 12/1941 Baldwin ..... 602/13
2,361,242 A * 10/1944 Rosett ..... 601/152
3,811,433 A * 5/1974 Brachet ..... 602/33
3,878,839 A * 4/1975 Norton et al. ..... 601/152
3,933,150 A 1/1976 Kaplan et al.
3,976,056 A * 8/1976 Brawn ..... 601/152
4,039,039 A 8/1977 Gottfried
4,353,359 A * 10/1982 Milbauer ..... 601/166
4,355,632 A * 10/1982 Sandman ..... 601/152
4,573,453 A * 3/1986 Tissot ..... 601/152
4,583,255 A * 4/1986 Mogaki et al. ..... 5/632
4,756,306 A * 7/1988 Curlee ..... 602/19
5,018,226 A * 5/1991 Davies et al. ..... 5/81.1 R
5,233,974 A * 8/1993 Senoue et al. ..... 601/149
5,938,628 A * 8/1999 Oguri et al. ..... 601/150
5,997,465 A * 12/1999 Savage et al. ..... 600/20
6,406,445 B1 6/2002 Ben-Nun (Continued)

FOREIGN PATENT DOCUMENTS

DE 8812125 U1 1/1989
DE 19725429 A1 12/1998

(Continued)

*Primary Examiner* — Justine R Yu
*Assistant Examiner* — Michael Tsai
(74) *Attorney, Agent, or Firm* — Dorsey & Whitney LLP

(57) ABSTRACT

A compression bag having an upper portion for applying a pressure at least to the abdominal area of a patient, and a lower portion for applying a pressure to at least a part of the patient's legs, the bag comprising a back part, a second, front part and a closure means configured for detachably attaching the parts to each other; a separating insert configured for being detachably attached to at least one of the back and front parts of the bag, at least at the lower portion of the bag, to separate between left and right regions of the first and second parts, thereby forming pants in said bag defined by said regions and said insert; and a plurality of inflatable cells in the first and second parts of the bag and in the separating insert, that are sealingly separated from adjacent inflatable cells and configured to be individually inflated and deflated.

20 Claims, 22 Drawing Sheets

(56) References Cited

U.S. PATENT DOCUMENTS

| | | | | |
|---|---|---|---|---|
| 6,558,338 | B1 | 5/2003 | Wasserman | |
| 6,645,165 | B2 * | 11/2003 | Waldridge et al. | 601/152 |
| 6,846,295 | B1 | 1/2005 | Ben-Nun | |
| 2002/0195855 | A1 * | 12/2002 | Teppo et al. | 297/284.6 |
| 2004/0054306 | A1 * | 3/2004 | Roth et al. | 601/152 |
| 2006/0020236 | A1 | 1/2006 | Ben-Nun | |
| 2006/0167390 | A1 * | 7/2006 | Hui | 601/152 |
| 2009/0177130 | A1 * | 7/2009 | Wegher-Thompson | 601/151 |

FOREIGN PATENT DOCUMENTS

| | | | |
|---|---|---|---|
| DE | 102007044188 | A1 | 3/2009 |
| FR | 2260323 | A1 | 9/1975 |
| WO | 9817224 | A1 | 4/1998 |
| WO | 2008104861 | A1 | 9/2008 |

* cited by examiner

COMPRESSION BAG

CROSS-REFERENCE TO RELATED APPLICATIONS

This application claims the benefit of prior IL application No. 201497 filed on Oct. 13, 2009 and U.S. provisional patent application No. 61/301,345 filed on Feb. 4, 2010, the contents of which are hereby incorporated by reference in their entirety.

FIELD OF THE INVENTION

The subject matter of the present application refers to compression therapy devices and methods of treatment, in particular to a device and method of treatment of lymphedema.

BACKGROUND OF THE INVENTION

Lymphedema is a medical condition in which lymphatic return in the soft tissues is interrupted or reduced. The area of the body from which outflow has been compromised becomes swollen with lymph fluid, and as the condition progresses, may become fibrotic as scar tissue accumulates. Lymphedema generally affects the extremities but may also affect the abdomen, genitals and other areas of the torso. When the limb becomes fibrotic and greatly enlarged, the disease is known as elephantiasis. Lymphedema can afflict people of any size; however, it frequently afflicts the morbidly obese. In some cases the patient's lymphedema is in itself the cause of morbid obesity; in other cases, morbid obesity leads to lymphedema.

Lymphedema is treated primarily by compression and special massage. One of the most effective techniques is calibrated gradient sequential compression therapy with a multiplicity of inflating chambers, which inflate and deflate in a predetermined sequence.

U.S. Pat. No. 6,406,445 discloses a garment comprising a pneumomassage articulated sleeve adapted to fit onto a foot, lower leg and an abdominal area of a patient afflicted with lymphedema or other disorder resulting in excess body fluid. Enveloped by the sleeve is a series of overlapping inflatable cells which when the sleeve is worn, are sequentially inflated to create massaging forces giving rise to a peristaltic action pumping the excess fluid away from the foot, leg and abdominal area. Along the rear of the sleeve is a row of transverse slots forming articulation joints, each of which is normally fastened. To accommodate the sleeve to the patient's foot to be treated, a slot in the row is unfastened to define a foot section conforming to the foot of the patient and a leg section hinged to the foot section conforming to the lower leg of the patient.

There are only a few systems available for treating lymphedema of the morbidly obese, as these patients vary widely in shape, requiring expensive custom garments.

SUMMARY OF THE INVENTION

The subject matter of the present application particularly refers to a device and method of treatment of lymphedema of morbidly obese patients.

According to one aspect of subject matter according to the present application, there is provided a compression bag having an upper portion for applying a pressure at least to the abdominal area of a patient, and a lower portion for applying a pressure to at least a part of the patient's legs, the bag comprising:

a back part, a second, front part and a closure means configured for detachably attaching the parts to each other;

a separating insert configured for being detachably attached to at least one of the back and front parts of the bag, at least at the lower portion of the bag, to separate between left and right regions of the first and second parts, thereby forming pants in said bag defined by said regions and said insert; and a plurality of inflatable cells in the first and second parts of the bag and in the separating insert, that are sealingly separated from adjacent inflatable cells and configured to be individually inflated and deflated.

The separating insert may be configured to be detachably attached to both the first and the second parts of the bag.

The separating insert may comprise at least one insert member detachable therefrom and including at least one inflatable cell, the detachment of which allows for the reduction of the separating insert's length.

At least one inflatable cell of the separating insert may be configured for fluid communication with an adjacent inflatable cell of the first or second part of the lower portion.

Some of the inflatable cells of the separating insert may be configured for fluid communication with the inflatable cells of the back part and some with the inflatable cells of the front part.

The front and the back parts of the bag may have longitudinal edges, where the closure means are located and are configured for being attached to one another by the closure means along these longitudinal edges.

The bag has a length direction substantially parallel to a height direction of a patient's body and a width direction substantially perpendicular to the longitudinal axis, and in the back and front parts of at least the lower portion of the bag, at least a part of the inflatable cells may extend along the entire width of the bag and these inflatable cells in the front and back parts are aligned with each other in the width and the longitudinal directions to form pairs of aligned front and back cells.

The or each inflatable cell of the insert, when attached to at least one of the back and front parts of the bag, may be aligned with one pair of said aligned cells along the longitudinal direction and extends along a central portion of said pair of aligned cells in the width direction.

Each of the front and back parts may be in the form of a sheet continuously extending between its right, left, upper and lower edges and having an inflatable layer with an inner sub-layer facing towards the bag's interior, an outer sub-layer facing away from the bag's interior, and partitions between the two sub-layers separating between adjacent inflatable cells and extending between the right and left edges of the corresponding sheets.

The separating insert may be in the form of at least one ridge having right and left walls which, when the insert is attached to at least one of the front and back parts, are oriented transversely to the inflatable layers of the front and back parts of the bag.

Each of the back and front parts of the bag may have left and right side edges, the closure means being configured for detachably attaching the side edges of the parts to each other.

According to another aspect of subject matter according to the present application there is provided a compression bag having an upper portion for applying a pressure at least to the abdominal area of a patient, and a lower portion for applying a pressure to at least a part of the patient's legs, the device comprising:

a back part and front part, each having two opposite left and right edges defining therebetween the width of the bag, and two opposite upper and lower edges defining the bag's upper and lower ends and the length of the bag therebetween, and a plurality of inflatable cells, each extending between the left and right edges of each of the front and back parts;

a closure means configured for detachably attaching the parts to each other along their corresponding right and left edges;

an inflatable layer in each of the front and back parts, comprising an upper sub-layer, a lower sub-layer, and a plurality of inflatable cells therebetween sealingly separated from each other; and a plurality of folds at the upper sub-layer of each of said front and back parts of the bag, formed along the entire width thereof and causing the lower end of the bag to be raised relative to the remainder of the lower portion of the bag, when the front and back parts are attached to each other by said closure means, forming thereby a feet area of the bag.

According to another aspect of subject matter according to the present application there is provided a compression bag having an upper portion for applying a pressure at least to the abdominal area of a patient, and a lower portion for applying a pressure to at least a part of the patient's legs, the bag comprising a back part, front part and a closure means configured for detachably attaching the parts to each other; each of the front and back parts being in the form of a sheet extending between its right and left edges, and having an inflatable layer with inflatable cells sealingly separated from each other, and a covering layer with at least one adjustable region, which is configured to change its state between an extended state in which the distance between the right and left edges of at least one of the back and front parts, has maximal value and at which at least one inflatable cell covered by said region is in its strengthened state, and a folded state at which said distance has a minimal value, and said inflatable cell is in its folded state at least at the area of said region, said cell in both states being inflatable along its entire extension between the right and left edges, said region being provided with a fastener configured for keeping said adjustable region in the folded state, and with means for allowing the passage of air via said inflatable cells, when said region and said cell are in the folded state.

The bag according to the second and third aspects of the subject matter according to the present application may further comprise any features of the bag according to the first aspect of the subject matter according to the present application in any combination.

According to another aspect of the subject matter according to the present application there is provided a method of preparation of a patient to a compression therapy to be performed by means of a compression bag having an upper portion for applying a pressure at least to the abdominal area of a patient, and a lower portion for applying a pressure to at least a part of the patient's legs, the bag comprising:

a back part, a second, front part and a closure means;

a separating insert;

a plurality of inflatable cells in the first and second parts of the bag and in the separating insert, that are sealingly separated from adjacent inflatable cells;

the method comprising:

(a) separating said front part from said back part at least at the upper portion, to allow accommodation of the patient on the back part of the bag;

(b) accommodating the patient;

(c) detachably attaching said insert to at least one of the back and front parts of the bag, at least at the lower portion of the bag, to separate between left and right regions of the first and second parts, before or after any of steps (a) and (b), thereby forming pants in said bag defined by said regions and said insert; and (d) detachably attaching said front and back parts to each other by means of said closure means, to have the bag closed along its lower and upper portions.

The bag used in the method described above may comprise any of the features according to the above aspects of the subject matter according to the present application, in any combination.

The method may further comprise an adjustment of the length of the separating insert by reducing therefrom or adding thereto said inflatable cells.

The method may further comprise accommodating the patient within the bag so that the patient's feet are received within the feet area of the bag.

The method may further comprise adjusting the adjustable region from its extended state to its folded state by means of the fastener.

Due to the structure of the bag according to the subject matter of the present application, and in particular the way it forms pants, the bag according to the subject matter of the present invention can diminish or even eliminate any need in assistance to a patient in wearing it or in receiving a therapy. This fact is especially important for morbidly obese patients who suffer from restricted mobility due to their great weight having extreme difficulty donning and doffing pneumatic compression therapy garments and usually do not have any assistance in donning and doffing pneumatic compression therapy garments for treating lymphedema.

In this connection, it should be noted that lymphedema affects the morbidly obese in the abdomen and inner legs, more so than in the normative sized lymphedema patient. Lymphedema of morbid obesity tends to affect the abdomen, which is often pendulous, sometimes hanging down below the knees. Patients with morbid obesity may get huge lobules of fat and lymphatic fluid, known as "massive localized lymphedema," on their inner thighs and legs. The bag according to the subject matter of the present application can access and, therefore, treat these areas. In particular, the separating insert, being located between the patient's legs, is configured for applying pressure to the inner parts of the legs. The adjustable regions of the bag, when kept in their folded state by the fastener, apply increased pressure to the abdominal area of the patient.

The bag according to the subject matter of the present application has great adjustability due to the possibility to control the separating insert's length, to achieve a better fit between the bag and the patient by fastening the adjustable regions and the option to add adjustment side inserts. This allows the bag to be produced as a one-size garment, overcoming great size and extreme variability of shapes of the patients, which is extremely advantageous for mass production, and then be adjusted individually for each patient at bedside without compromising the compression. In addition, the bag overcomes significant fluctuations in the patients' shape and size that may occur as treatment progresses.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
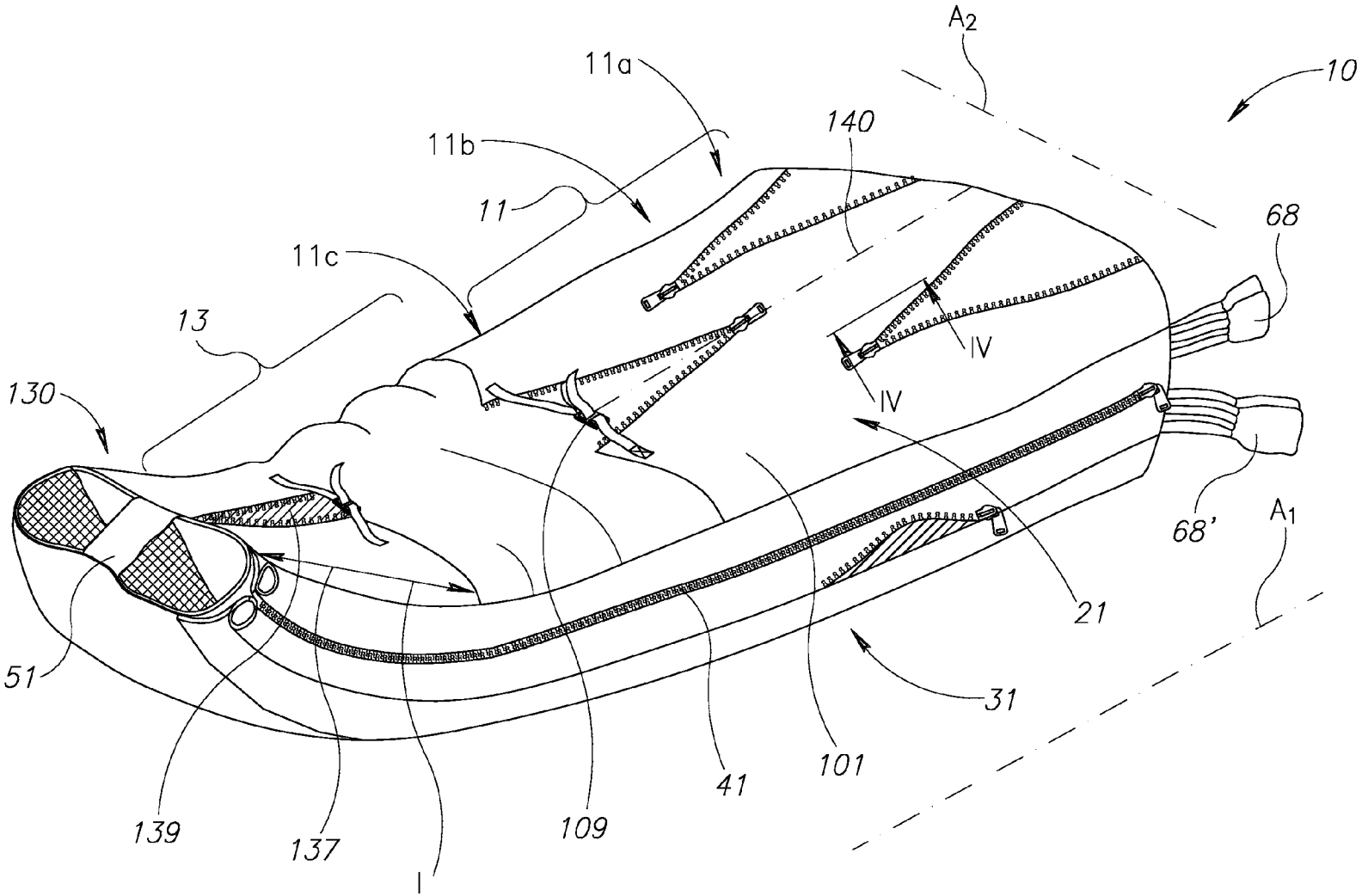
FIG. 1A is a schematic view of one example of a compression bag according to the subject matter of the present application, in a closed and inflated state.
Figure 1B:
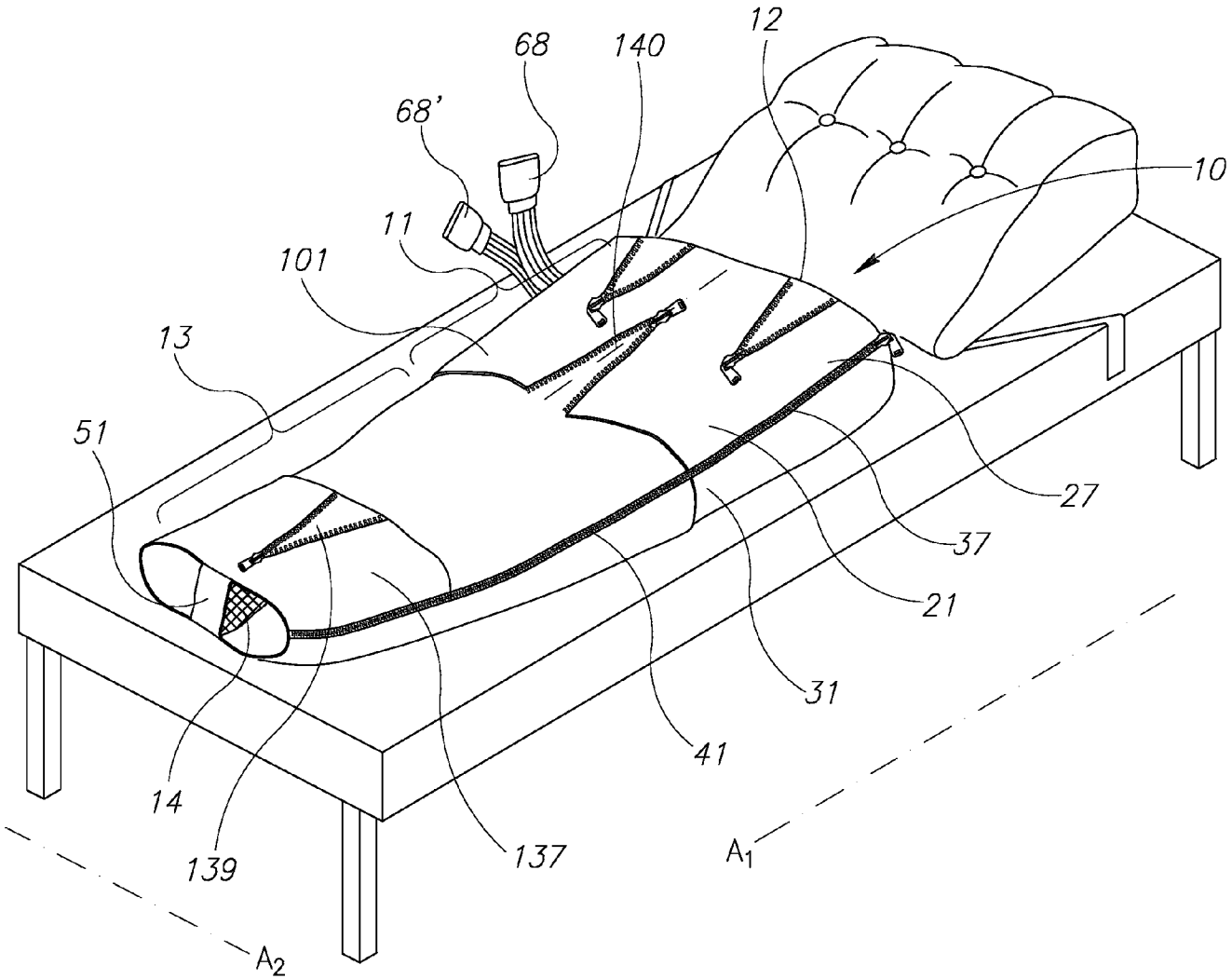
FIG. 1B is a schematic view of another example of a compression bag according to the subject matter of the present application, in a closed and inflated state, shown on a treatment bed.
Figure 1C:
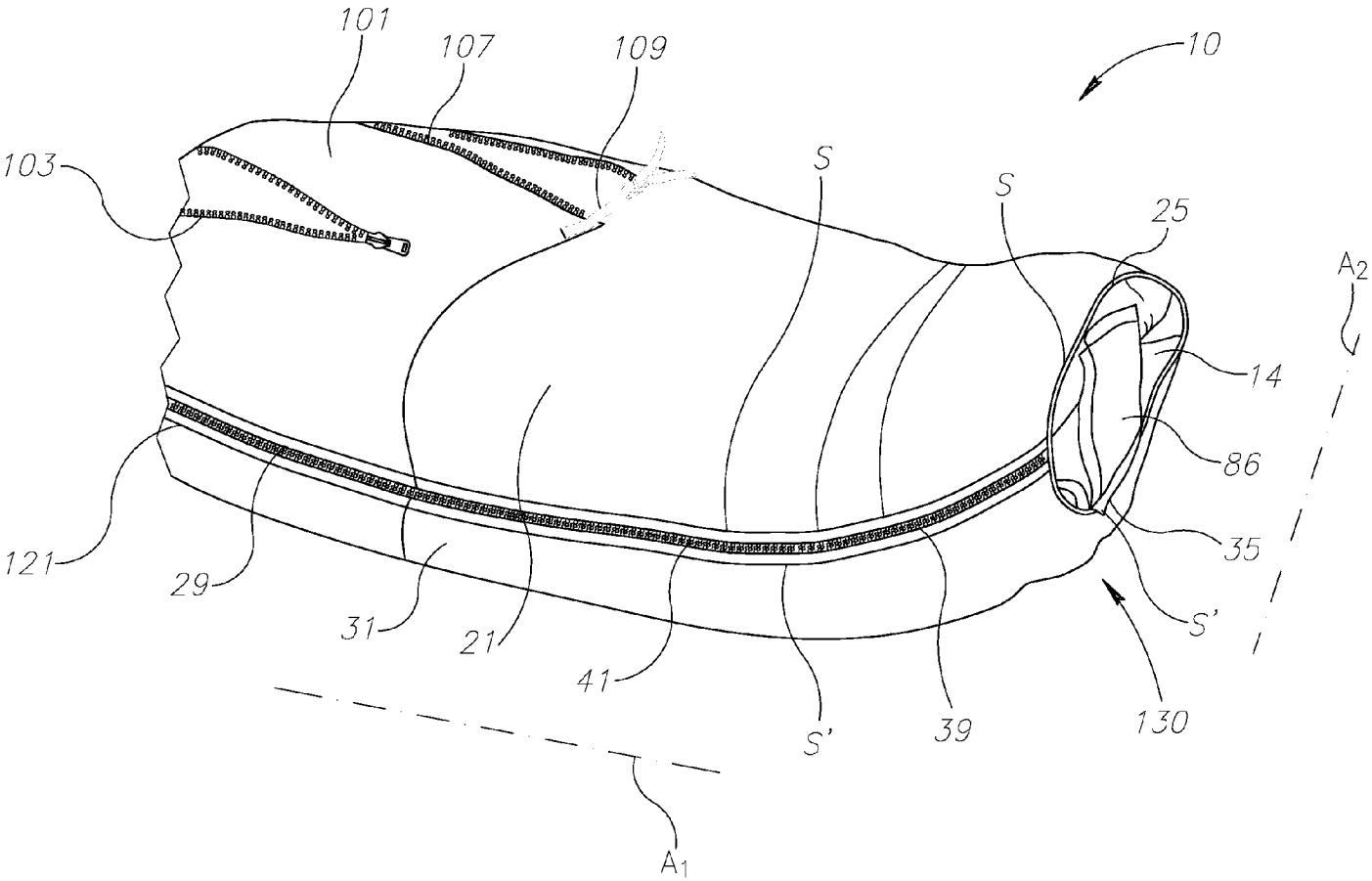
FIG. 1C is a photographic view of a still further example of a compression bag according to the subject matter of the present application, in a closed and inflated state.

With reference to FIGS. 1A to 1C, there is illustrated a compression bag 10 according to the subject matter of the present application, to be used with a pressurized fluid source, e.g., air source, and configured to apply pressure to the body of a patient (not shown), as will be further described in detail, so that an upper portion 11 of the bag 10 is configured for applying pressure to at least the abdominal area of the patient and a lower portion 13 of the bag 10 is configured for applying pressure to at least a part of the patient's legs.

The compression bag 10 has a longitudinal dimension along its longitudinal axis $A_1$ and a transverse dimension (width) along its transverse axis $A_2$, and it comprises a front part 21 and a back part 31 (best seen in FIG. 1C) that extend along the entire longitudinal and transverse dimension of the bag, a closure means 41 for detachably attaching the parts to each other along the entire longitudinal dimension of the bag, and a separating insert arrangement 51 extending only along a portion of the longitudinal and transverse dimensions of the bag.

Figure 2:
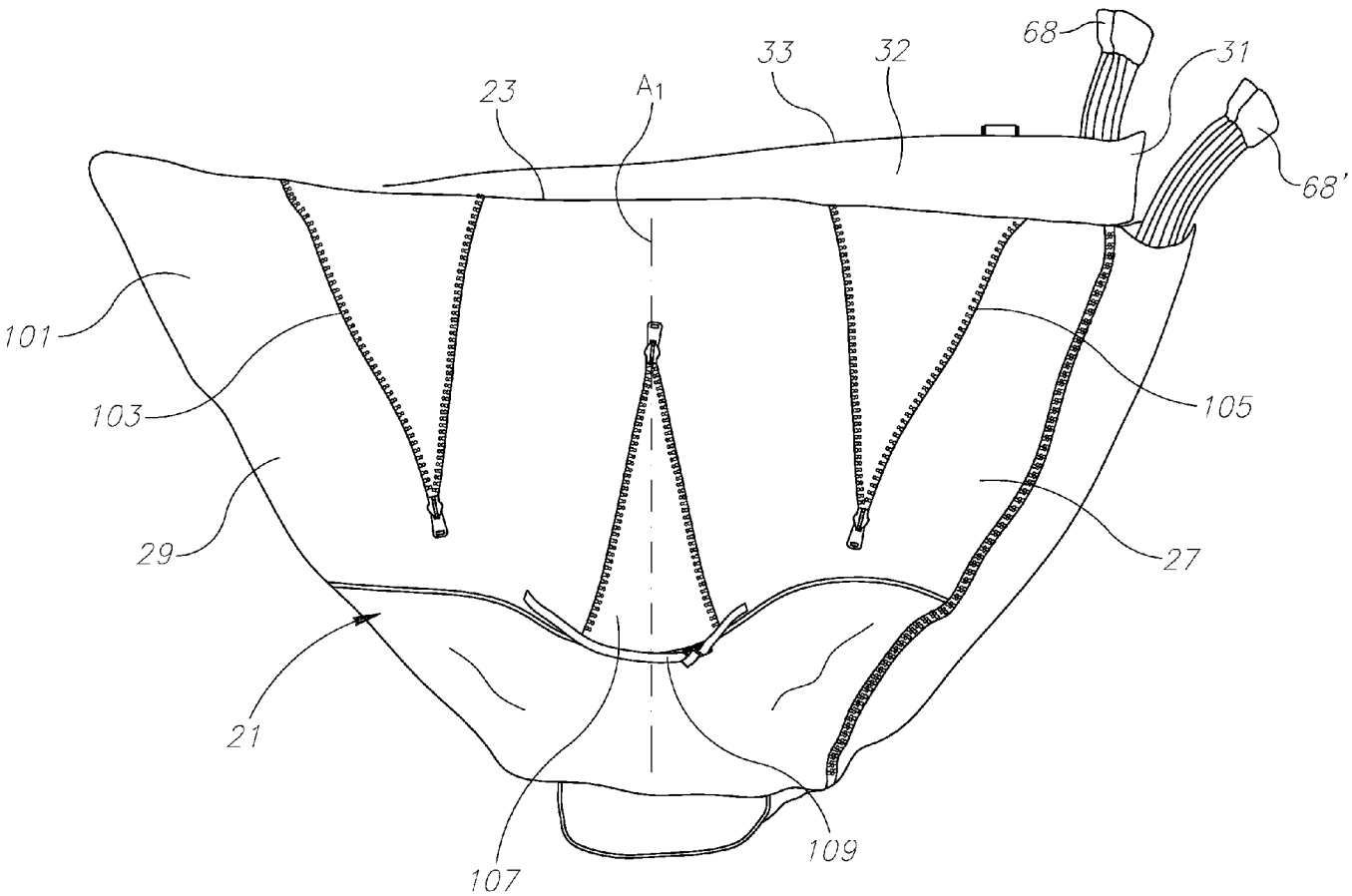
FIG. 2 is a photographic view of the sleeve shown in FIG. 1C, in an open and deflated state.

The front 21 and the back 31 parts of the bag 10 are formed as sheets, having upper edges 23 and 33 (FIG. 2), lower edges 25 and 35 (FIG. 1C), right edges 27 and 37 (FIG. 1B) and left edges 29 and 39 edges (FIG. 1C), respectively.

In FIGS. 1A to 1C, the front part 21 and the back part 31 are shown, attached one to another along the right 27 and the left 27 edges by the closure means 41, such as zippers while along the upper edges 23 and 33 and the lower edges 25 and 35 the bag 10 remains open, forming thereby an upper opening 12 and a lower opening 14.

Figure 3:
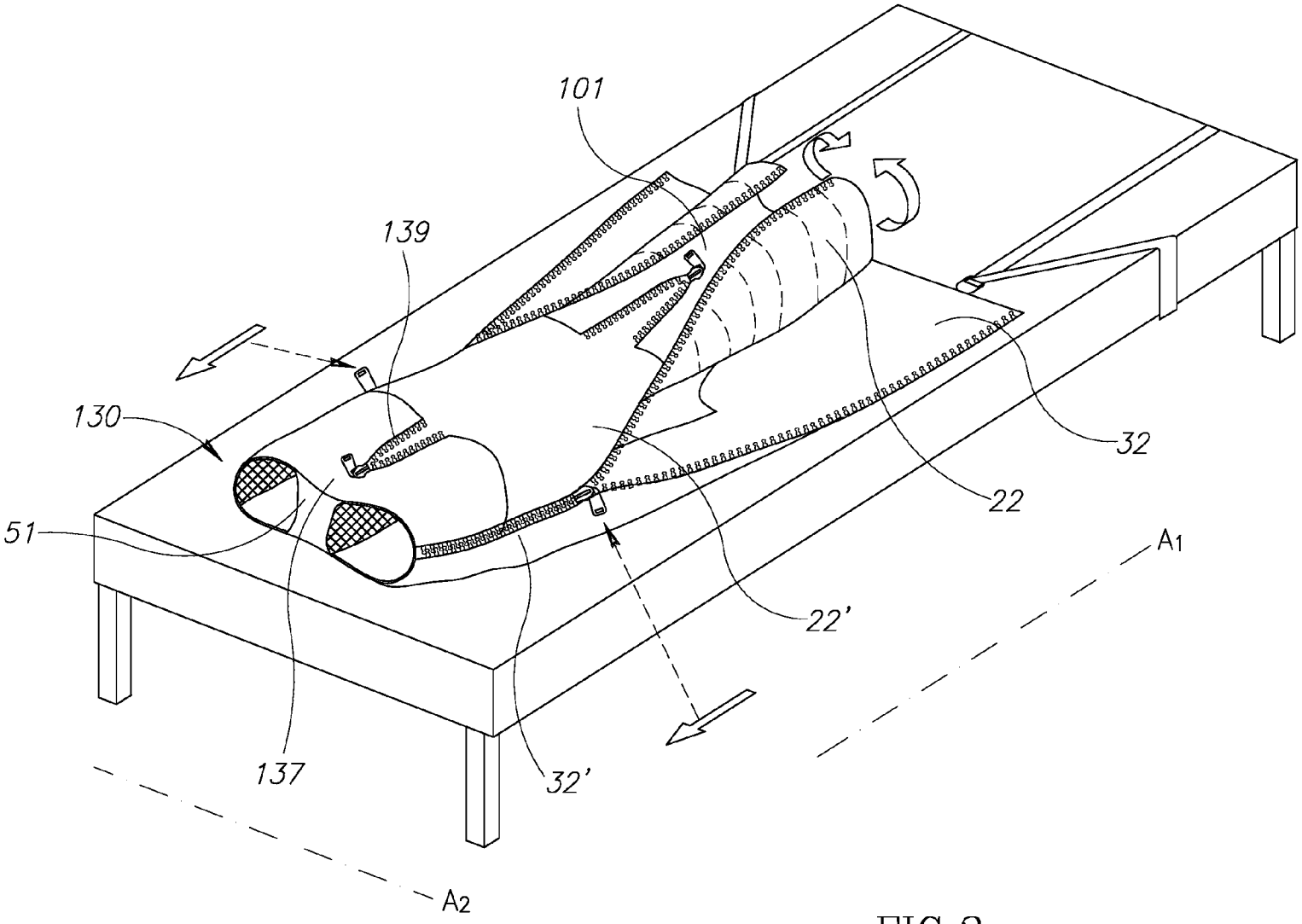
FIG. 3 is a schematic view of the bag shown in FIG. 1B, in a partially open and inflated state.
Figure 4:
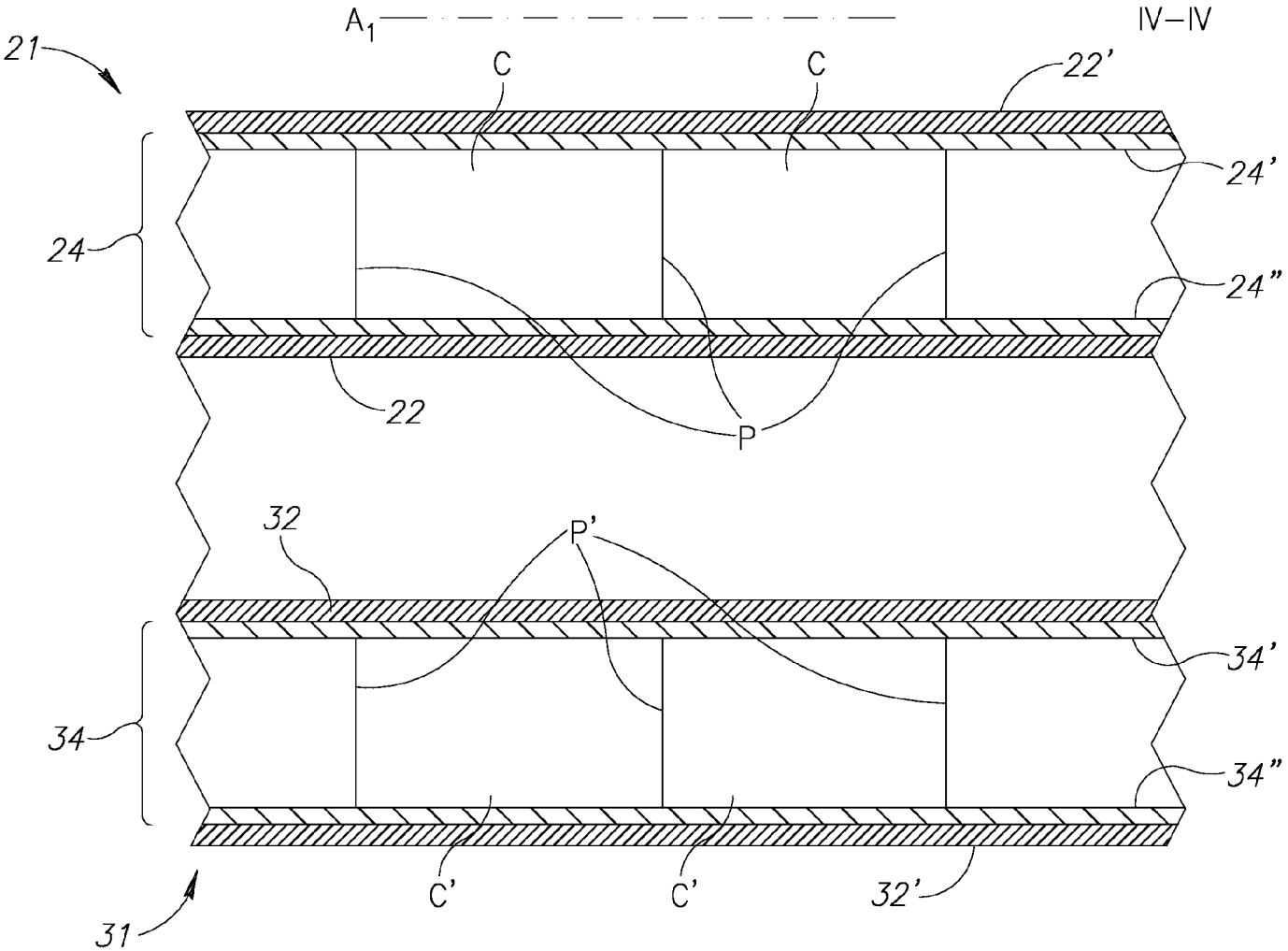
FIG. 4 is a schematic simplified presentation of a cross-sectional view of a bag shown in any of FIGS. 1A to 1C, taken along a line IV-IV in FIG. 1A (the bag in this figure is shown, for the purpose of illustration only, in a theoretical state in which all its surfaces and walls are completely planar)

With reference to FIGS. 3 and 4, the front 21 and the back 31 parts comprise inner protection layers 22 and 32, outer protection layers 22' and 32', and inflatable intermediate layers 24 and 34, respectively, therebetween. The inner protection layers 22 and 32 face towards the bag's interior, and the outer protection layers 22' and 32' face away from the bag's interior. The inner protection layers 22 and 32, inflatable intermediate layers 24 and 34, and the outer protection layers 22' and 32' of each of the front 21 and back 31 part of the bag 10 are all connected, optionally sealingly, along exterior seams S and S' (some shown in FIG. 1C) extending along the corresponding upper 23, 33, lower 25, 35, right 27, 37 and left 29, 39 edges of these parts. The connection along the seams S can be provided, for example, by such processes, as for example welding, adhesive bonding, or radio frequency treatment, and the like. It should be explained that in FIG. 4 the intermediate layers are shown connected to the inner and outer protection layers solely for the simplification of the illustration, and in practice, this does not at all need to be the case.

The inner protection layers 22 and 32 and outer protection layers 22' and 32' are made of washable material, allowing for multiple use of the compression bag, such as Nylon fabric.

With reference to FIG. 4, each of the inflatable layers 24 and 34 of the front 21 and back 31 parts comprises two sub-layers 24' and 24", and 34' and 34", respectively, each made of a fluid impervious material, such as for example Nylon 70DN laminated with polyurethane.

The inflatable layers 24 and 34 further comprise partitions $P_1$ to $P_{N-1}$ and $P_1'$ to $P_{N-1}'$, respectively, extending between and sealingly attached to the sub-layers 24' and 24", and 34' and 34", respectively to form therebetween N inflatable cells $C_1$ to $C_N$ and $C_1'$ to $C_N'$, respectively, within the inflatable layers 24 and 34. The inflatable cells $C_1$ to $C_N$ and $C_1'$ to $C_N'$ extend along the transverse axis $A_2$ of the bag 10 between the right edges 27, 37 and left edges 29, 39 of its front 21 and back 31 parts.

Figure 5:
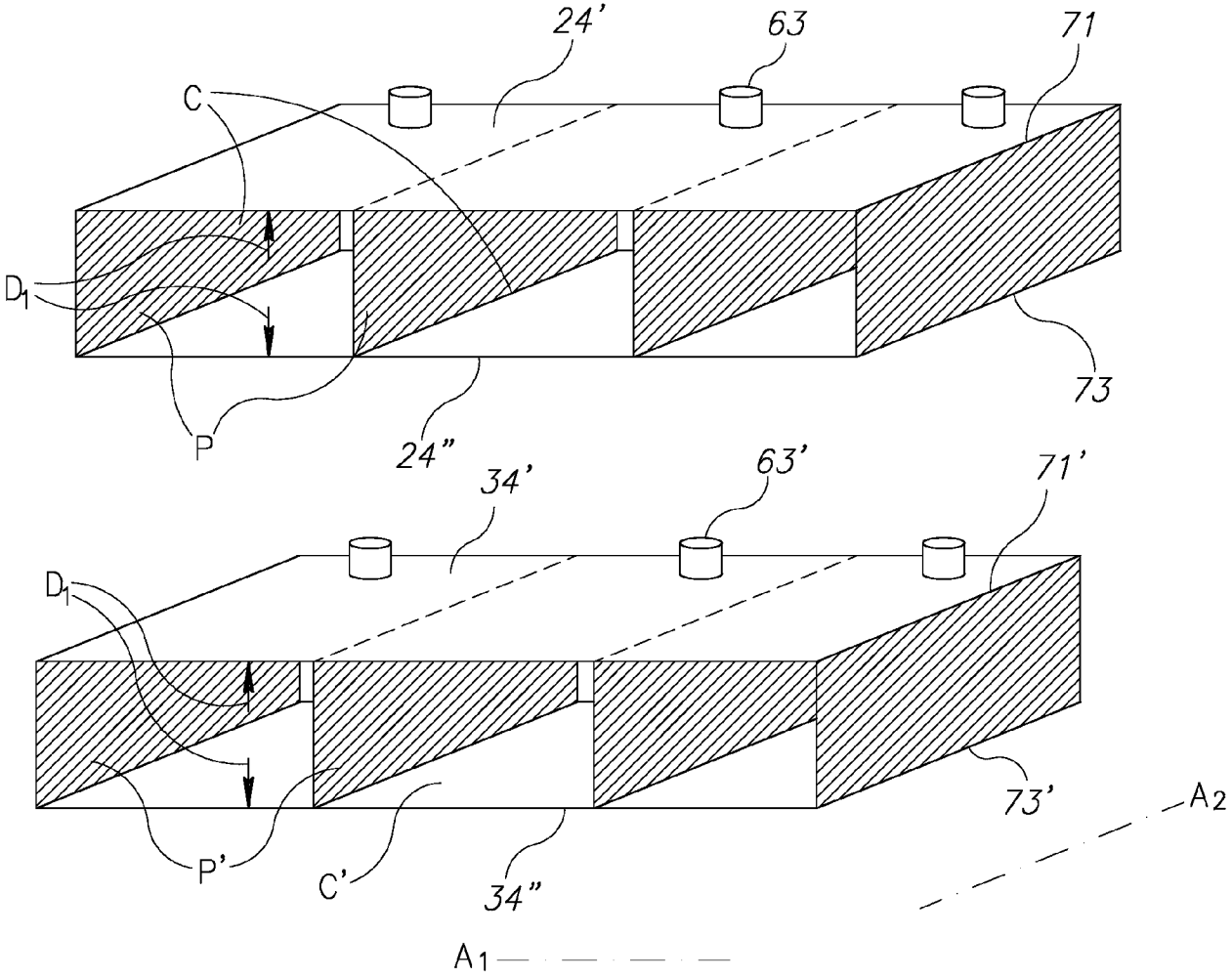
FIG. 5 is a schematic simplified isometric presentation of the view of the bag shown in FIG. 4.

With reference to FIG. 5, each of the partitions $P_1$ to $P_{N-1}$ and $P_1'$ to $P_{N-1}'$ comprises an outer partition edge 71, 71', sealingly attached to the corresponding inflatable layer 24', 34', and an inner partition edge 73, 73', sealingly attached to the corresponding layer 24", 34" along seams provided by such means as welding, adhesive bonding, or radio frequency treatment, and the like. The partitions are made of an impervious material, which is more flexible and resilient than the material of the sub-layers. This material can be of a kind that is stretchable up to 25, in particular, up to 35, and more particularly up to 40%, and it can be, for example, thermoplastic polyurethane (TPU).

Each cell $C_1$, $C_1'$ to $C_N$, $C_N'$ comprises an inlet 63, 63' sealingly attached to any one of the sub-layers 24', 24", 34', 34" defining the cell. In FIG. 5, the inlets 63 and 63' are attached to the upper sub-layers 24', 34' of the intermediate layers 24 and 34 adjacent to the right edge 27, 37 of the front 21 and back 31 parts of the bag 10.

Figure 6A:
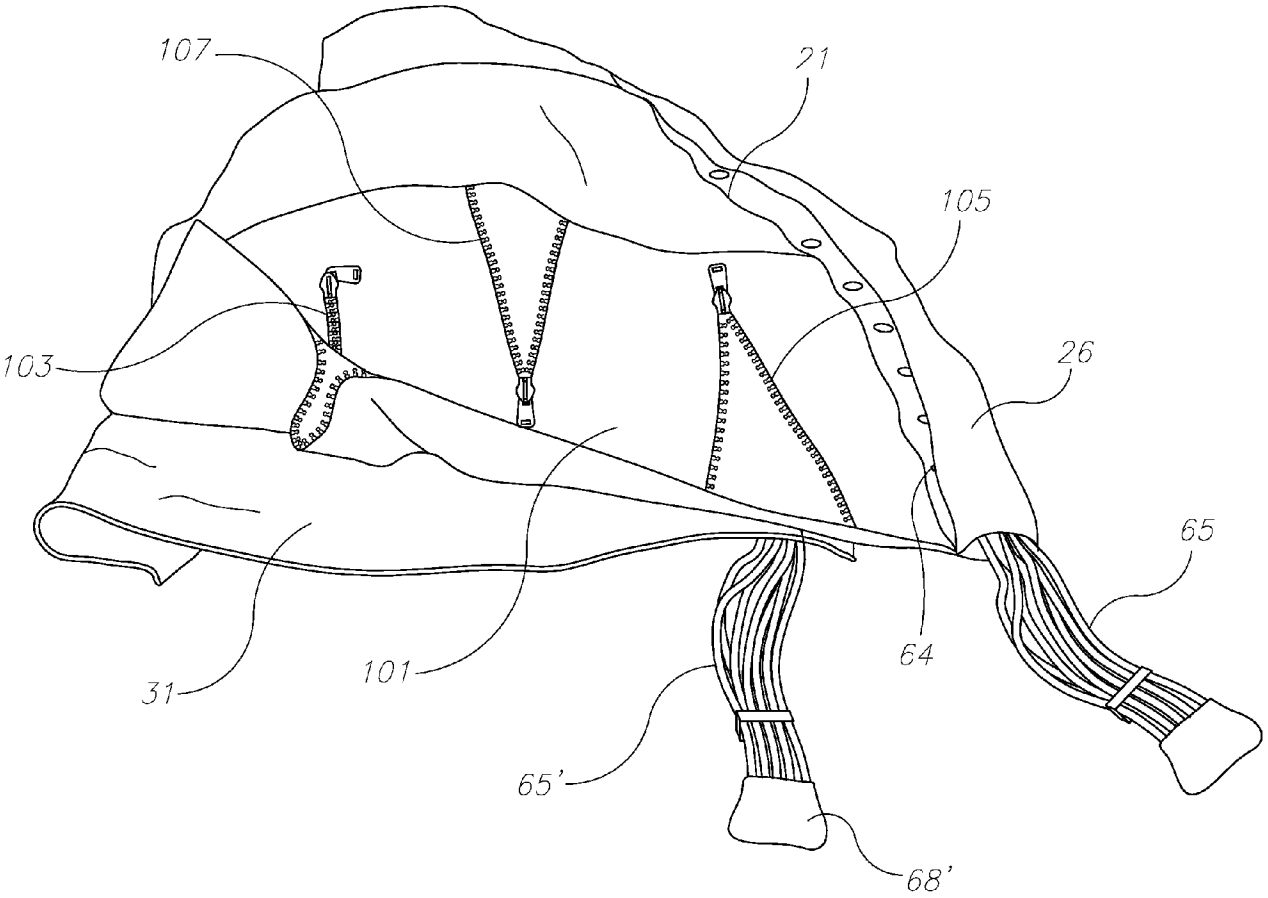
FIG. 6A is a photographic view of the bag shown in FIG. 1C, in an open and deflated state, with one of zippers in its adjustment layer being closed.
Figure 6B:
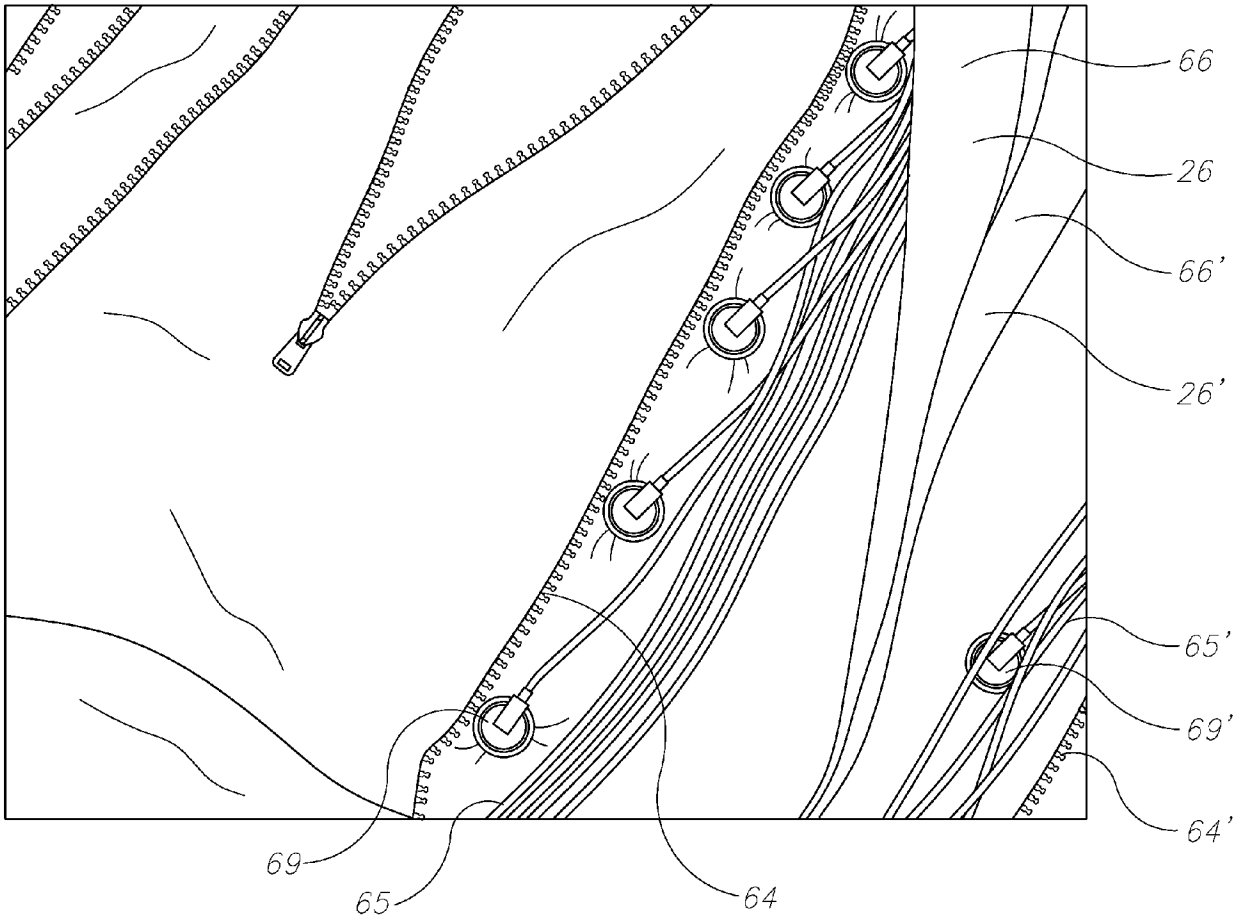
FIG. 6B is a close photographic view of a portion of the bag shown in FIG. 1C.

With reference to FIGS. 6A and 6B, each of the front 21 and back 31 parts of the compression bag 10 comprises a fluid connection interface 26 and 26' (FIG. 6B) extending along one edge 27, 37 thereof and formed with openings 69, 69' spaced from the corresponding edge, each receiving therein the inlet 63, 63' of one of the cells $C_1$ to $C_N$ and $C_1'$ to $C_N'$, for connecting the cell to its corresponding fluid line 65, 65'. The interfaces 26 and 26' are formed with covers 66, 66' (FIG. 6B) permanently attached at one edge to the edge 27, 37 of the corresponding front 21 and back 31 part of the bag 10 and detachably attachable to the these parts along an attachment line 64, 64' spaced from the corresponding edges further than the openings 69, 69' to form, when attached, sleeves receiving therein all the lines 65 and 65' when the bag 10 is in use. The detachable attachment may be obtained by such means as zippers, hook and loop fasteners or the like. Each of the lines 65 and 65' are attached to a plug 68, 68' (FIGS. 1A, 1B, 6B) that is configured for the connection of each line 65, 65' to the pressure source.

The cells $C_M$ to $C_N$ and $C_M'$ to $C_N'$ that are associated with the lower portion 13 of the bag 10 and a part of the upper portion 11, further comprise, substantially in the middle thereof, fluid outlets 69 and 69' (not shown) formed in the layers 24" and 34', both facing towards the interior of the bag 10, allowing a fluid communication of these cells with the separating insert arrangement 51, as explained in detail below.

With reference to FIGS. 7A to 8A, the separating insert arrangement 51 is configured to be detachably attachable to the inner protection layer 22 of the front part 21 and the inner protection layer 32 of the back part 31 of the bag 10 by such means as, for example, hook and loop fasteners, allowing its complete removal from the bag 10 if required. The insert arrangement 51 is configured to occupy a central region M (shown in dotted line in FIG. 7A) of the lower portion 13 of the bag 10 and, optionally, of an adjacent part of the upper portion 11.

The insert arrangement 51 has an upper end 80 configured to be located adjacent area 78 of imaginary merger of the upper 11 and lower portion 13 portions of the bag 10, and a lower end 82 configured to be located adjacent to the lower opening 14 of the bag 10, when the insert arrangement is attached thereto as shown.

Figures 7A, 7B:
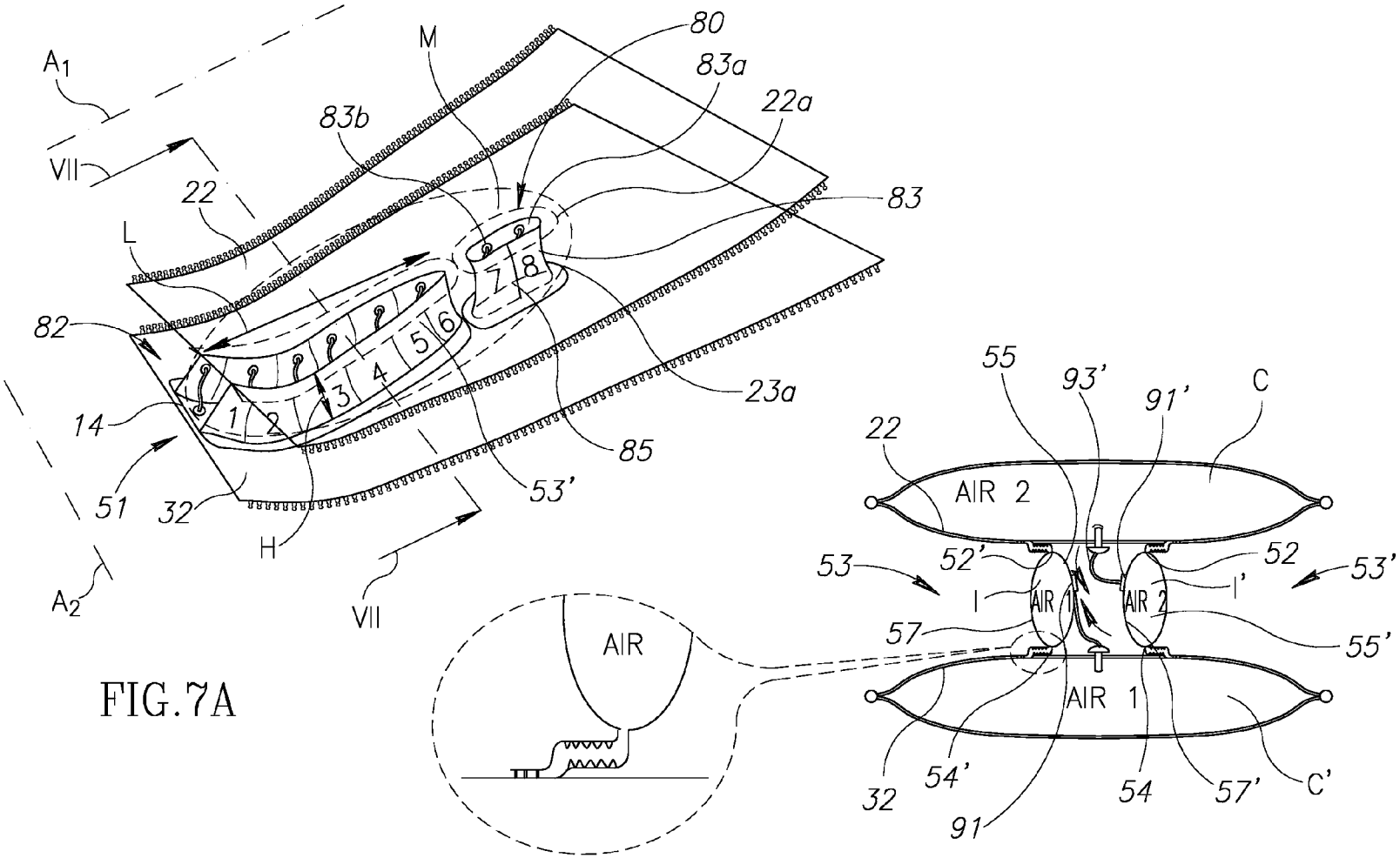
FIGS. 7A and 7B are schematic perspective and end views, respectively, of one example of a separating insert arrangement in any of the compression bags shown in FIGS. 1A to 1C.

With reference to FIGS. 7A and 7B, the insert arrangement 51 will now be described in its attached state, and it comprises two longitudinal ridges: a left ridge 53 and a right ridge 53', both of a length L extending along the longitudinal axis A1 of the bag, and a height H perpendicular to both the longitudinal A1 and the transverse A2 axes of the bag 10, gradually decreasing from the upper end 80 to the lower end 82.

As shown in FIG. 7B, each ridge 53, 53' comprises a right wall 55, 55' and a left wall 57, 57', sealingly merging with each other at a front edge 52, 52' facing the inner protection layer 22 of the front part 21 and a back edge 54, 54' facing the inner protection layer 32 of the back part 31. The ridges 53 and 53' may have attachment flaps (not shown) attached to their front and back edges, that are detachably attached to the corresponding attachment strips 150 (FIG. 9A) and 150' (not shown) on the protection layers 22 and 32, which flaps and strips have for this purpose suitable hook and loop fasteners thereon.

Figure 8B:
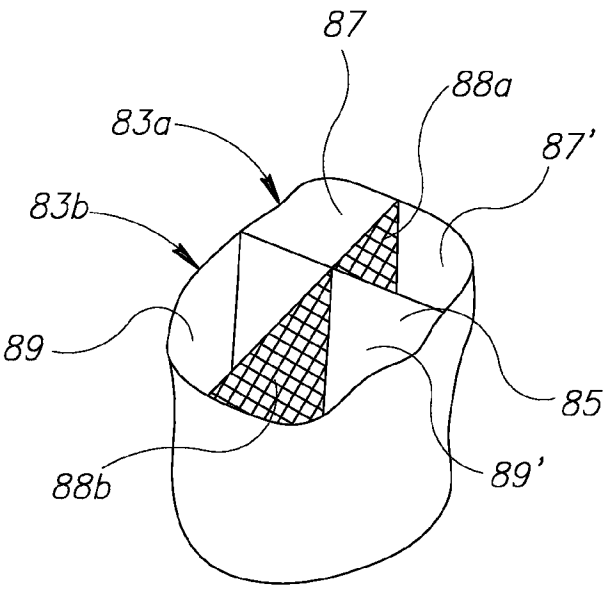
FIG. 8B is schematic, simplified presentation of an upper view of the interior of a detachable member of the insert arrangement shown in FIGS. 7A and 7B.
Figure 8A:
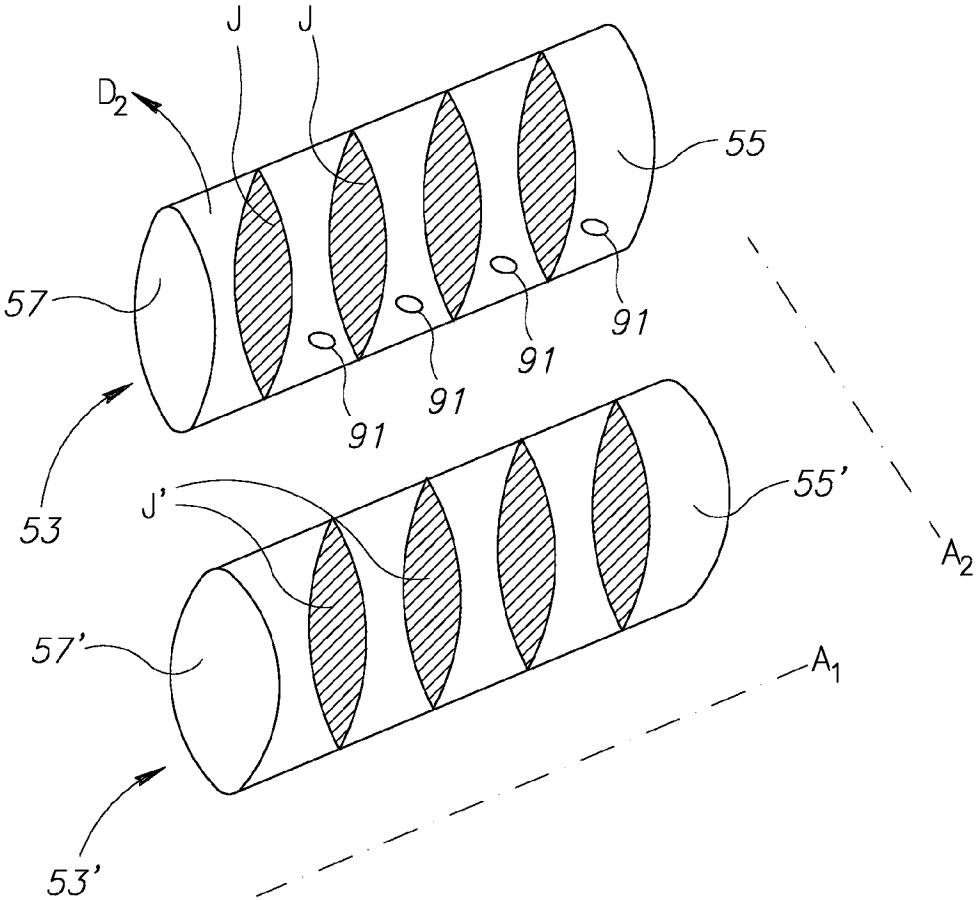
FIG. 8A is a schematic, simplified presentation of an isometric view of the interior of right and left ridges of the insert arrangement shown in FIGS. 7A and 7B.

As shown in FIGS. 7B and 8A, the longitudinal ridges 53 and 53' comprise a plurality of inflatable cells $I_M$ to $I_N$ formed between the right wall 55 and left 57 walls of the right ridge 53, and the longitudinal ridge 53' comprises cells $I_M'$ to $I_N'$ formed between the right wall 55' and the left wall 57', respectively. In each ridge 53, 53' the cells $I_M$ to $I_N$ and the cells $I_M'$ to $I_N'$ are spaced from their adjacent cells by partitions $J_M$ to $J_{M-1}$ and $J_M'$ to $J_{M-1}'$, respectively, the partitions $J_M$ to $J_{M-1}$ extending between the right wall 55 and the left wall 57 of the ridge 53, and the partitions $J_M'$ to $J_{M-1}'$ extending between the right wall 55' and the left wall 57' of the ridge 53'. These partitions $J_M$ to $J_{M-1}$ and $J_M'$ to $J_{M-1}'$ are thus oriented substantially perpendicular to the partitions $P_1$ to $P_{N-1}$ and $P_1'$ to $P_{N-1}'$ between the cells $C_1$ to $C_N$ and $C_1'$ to $C_N'$ of the front and back parts 21 and 31.

The ridges 53 and 53' are so attached to the front and back parts 21 and 31 of the bag 10 that the cells $I_M$ to $I_N$ and $I_M'$ to $I_N'$ are aligned with the corresponding cells $C_M$ to $C_N$ and $C_M'$ to $C_N'$ along the longitudinal axis $A_1$ of the bag, and they comprise fluid inlets 91 and 91', at the right wall 55 of the ridge 53 and the left wall 57' of the ridge 53', respectively. The inlets 91 are adapted to be connected to the fluid outlets 69 of the cells $C_M$ to $C_N$ by means of connecting tubes 93, and inlets 91' are adapted to be connected to the outlets 69' of the cells $C_M'$ to $C_N'$ by means of connecting tubes 93'.

The right walls 55 and 55' and the left walls 57 and 57' can be made of the same material as the sub-layers 24', 24", 34' and 34" described above and the partitions between these walls can be made of the same material, and can be attached to these walls, as the partitions $P_1$ to $P_{N-1}$ and $P_1'$ to $P_{N-1}'$ described above.

The ridges 53 and 53' of the insert arrangement 51 can be attached to each other and formed as one insert unit or they may be in the form of two different bodies, which can be composed of a plurality of individual sections that can be separately detachably attachable to the front and back parts of the bags (not shown).

Alternatively, the ridges 53 and 53' of the insert arrangement 51 can constitute its lower portion and the insert arrangement 51 can further comprise an upper portion formed as a separate detachable insert member 83, which can be configured to be detachably attached to the ridges 51 and 51', as shown in FIG. 7A, allowing thereby the adjustment of the length L of the insert arrangement 51. The detachable member 83 may comprise one or more pairs of left and right inflatable cells, a single inflatable cell or any combination of a single cell and one or more pairs of cells.

With reference to FIG. 8B, the detachable member 83 can comprise two rows of cells, 83*a* and 83*b*, separated one from the other by a partition 85, similar to the partitions $J_M$ to $J_{M-1}$ and $J_M'$ to $J_{M-1}'$ described above. Each row 83*a*, 83*b* comprises two cells 87 and 87', and 89 and 89', respectively. The cells are separated from each other by a wall 88*a*, 88*b* made of a material similar to that of the walls 55 and 55' of the ridges 53 and 53'. The cells 87, 87', 89 and 89' are connectable to the pressurized air source in the same manner as the cells of the ridges 53 and 53'.

The attachment of the detachable insert member 83 to the inner protection layers 22 and 32 is provided along the entire periphery thereof and therefore it is stronger than the that of the ridges 53 and 53'. For this purpose the detachable member 83 comprises attachment flaps 88 (FIG. 8B) and the layers 22 and 32 comprise corresponding attachment areas 22*a* and 32*a*, as shown in FIG. 7A, which have suitable hook and loop fasteners thereon.

The length L of the separating insert arrangement 51 can be further controlled by connecting and disconnecting some of the cells $I_M$ to $I_N$ and $I_M'$ to $I_N'$ from their corresponding cells $C_M$ to $C_N$ and $C_M'$ to $C_N'$. In particular, if the length of the separating insert arrangement 51 is required to be shorter than its length after removing the detachable member 83, one or more pairs of cells of each ridge, closest to the upper end 80 of the insert arrangement will be disconnected from the fluid supply, and ridges may be folded accordingly, until the insert arrangement 51 reaches the desired length.

Figure 9A:
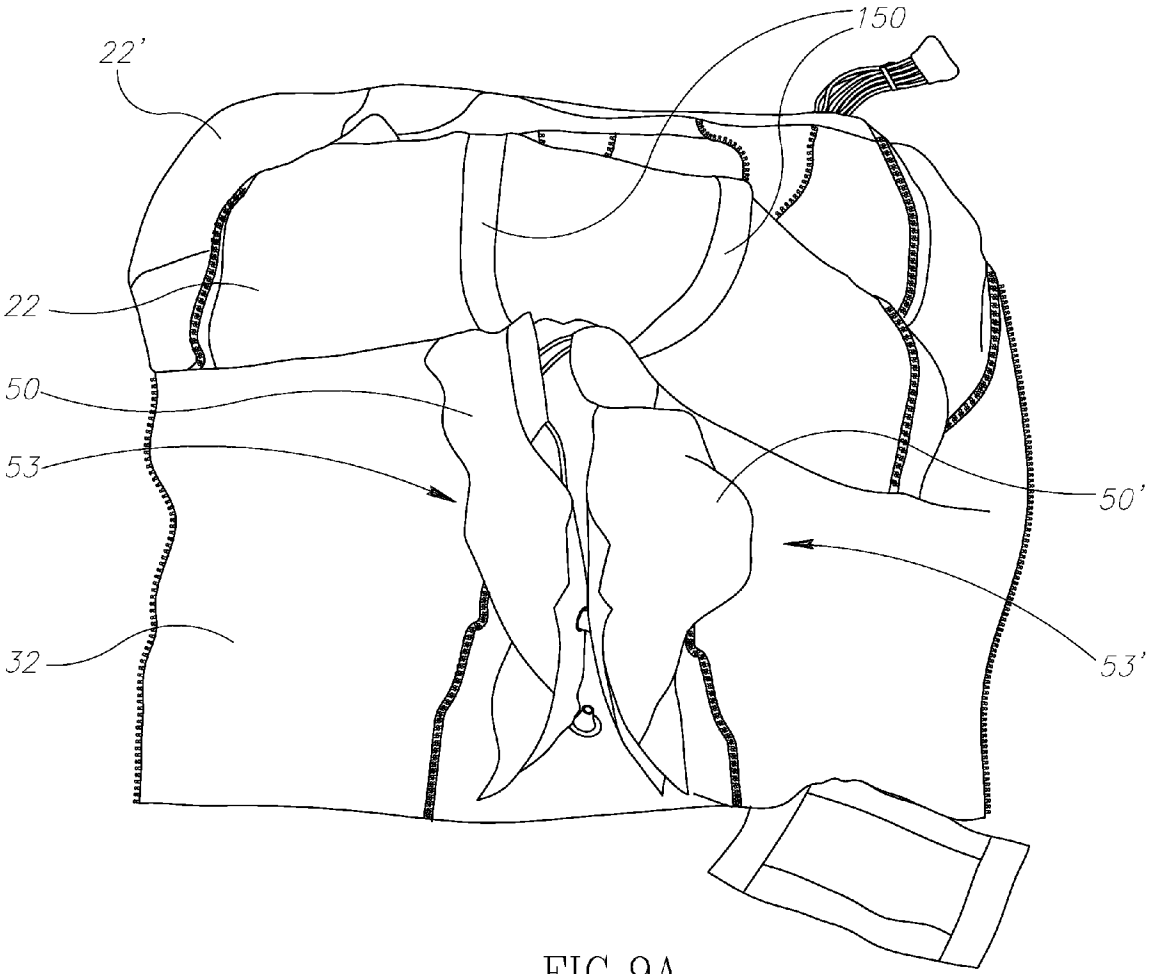
FIG. 9A is a photographic view of the bag shown in FIG. 1C, in an open and deflated state, with its front part being raised to demonstrate one possible design of the insert arrangement shown in FIGS. 7A and 7B.
Figure 9B:
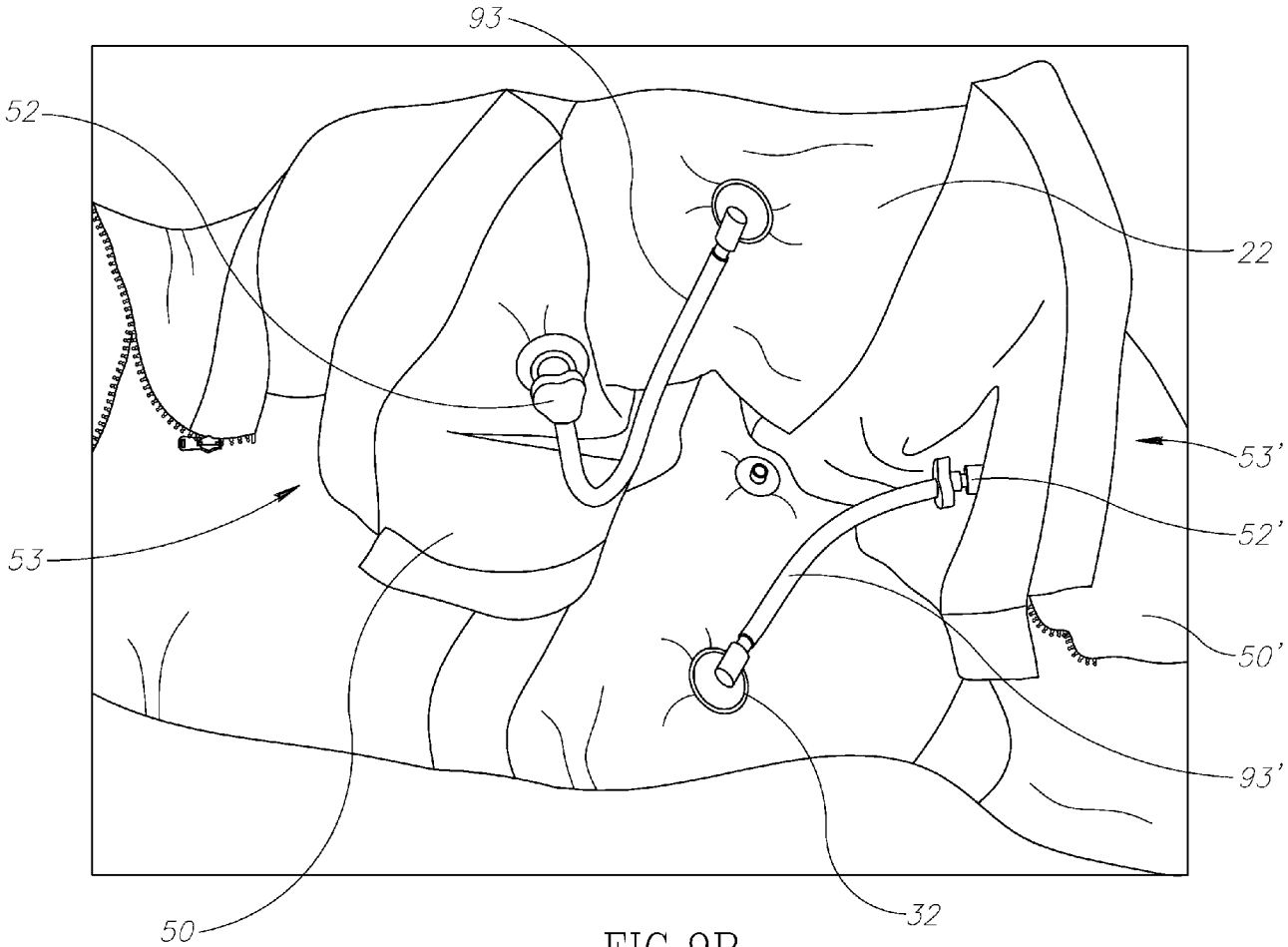
FIG. 9B is a close photographic view of the insert arrangement in the bag shown in FIG. 9A, with its fluid communication tubes.

With reference to FIGS. 9A and 9B, the ridges 53 and 53' of the separating insert arrangement 51 may further comprise protection sleeves 50 and 50' configured to be attached to the attachment strips 150 and 150' of the layers 22 and 32, respectively. Each of the right and left walls of the ridges 53 and 53' is attached to the sleeves 50 and 50' along its edges 52, 52' and 54, 54' (FIG. 9B) and along the areas of attachment of the partitions $J_M$ to $J_{M-1}$ and $J_M'$ to $J_{M-1}'$ to the right and left walls. As shown in FIG. 9B, the sleeves 50 and 50' comprise openings 52 and 52', respectively, via which the fluid inlets 91 and 91' of the cells $I_M$ to $I_N$ and $I_M'$ to $I_N'$, project for their connection with the connecting tubes 93, 93', allowing thereby a fluid communication of these cells with the corresponding cells $C_M$ to $C_N$ and $C_M'$ to $C_N'$.

Figure 10:
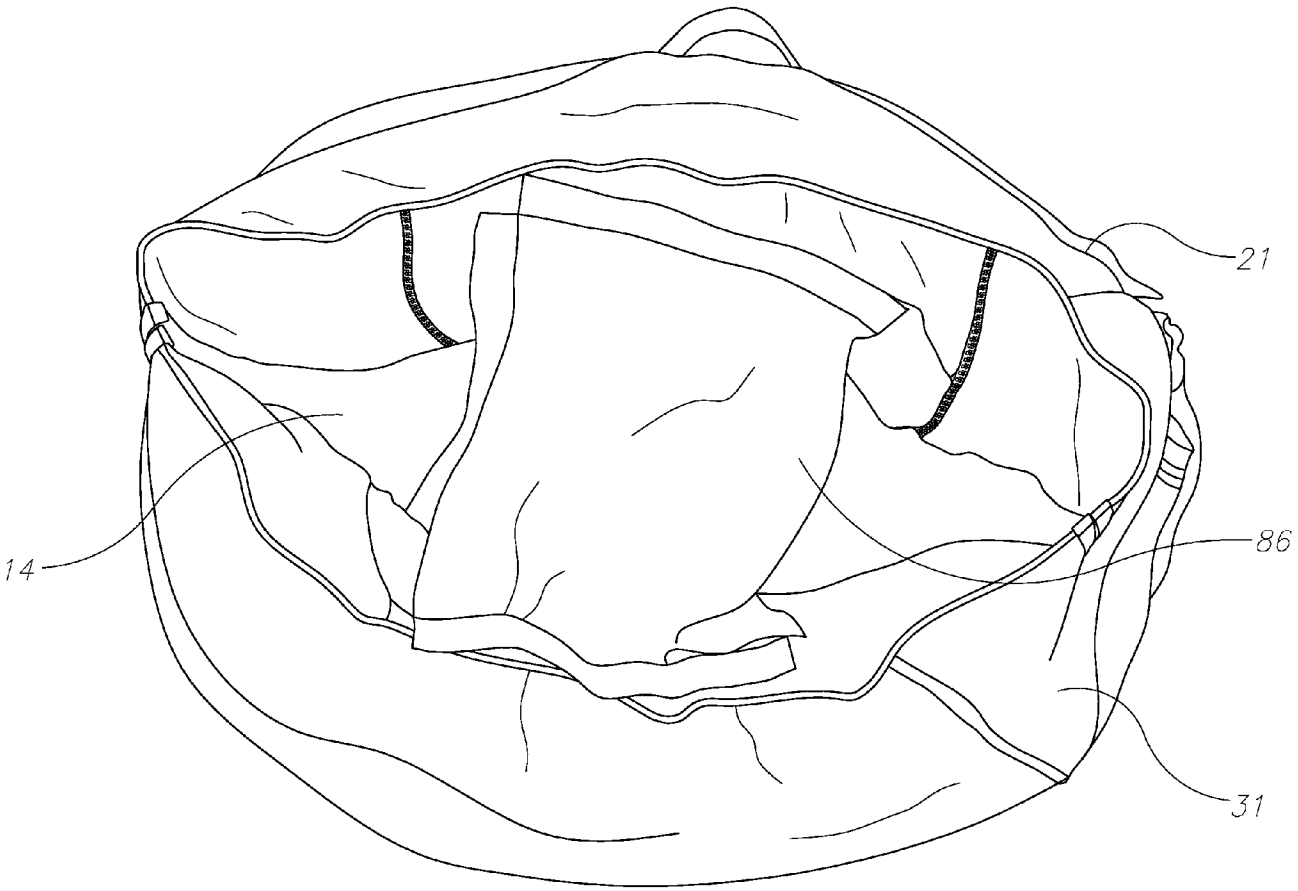
FIG. 10 is an end view of the bag shown in FIG. 1C.

With reference to FIG. 10, the lower end 82 of the separating insert arrangement 51 may comprise a lower end cover 86 (also shown in FIG. 1C) configured for covering flanges of both ridges 53 and 53', The lower end cover 86 is detachably attachable to the ridges 53 and 53', or front and back parts 21 and 31 by any suitable attachment means such as such as hook and loop fasteners and serves mostly for esthetic purposes.

The bag 10 further comprises external adjustment layers 101 and 121 in any one or both of the front part 21 and the back part 31, respectively, as shown in FIGS. 1A to 3, 6A and 11A. The adjustment layers 101 and 121 extend along at least that portion of the outer protection layers 22' and 32' where adjustment of the width of the bag may be desirable, such as the upper portion 11 of the bag 10.

The adjustment layer 101 can comprise one or more adjustable zones disposed at different locations relative to its imaginary central line 140 that is parallel to the longitudinal axis A.sub.1 of the bag, such as upper adjustable zones 103 and 105 disposed on two sides from the central line 140 (FIGS. 1A and 1B) at an upper area 11*a* of the upper portion 11 from the upper end 12 of the bag 10 towards a central area 11*b* thereof, and a central adjustable zone 107 extending along the central line 140 at a lower area 11*c* of the upper portion 11 (the areas in FIG. 1A). Each of the adjustable zones can take different states such as being completely open (as shown in FIGS. 1A to 1C and 2), partially closed (as the adjustable zone 103 in FIG. 11A) or completely closed (as the adjustable zone 105 in FIG. 11A), and they can be adjusted before the bag 10 is in use, or when already in use, as will be described in detail below. As shown, the adjustable zones may be in the form of zippers with or without tightening straps, such as a tightening strap 109 shown in FIGS. 1A, 1C, 2 and 11A, for preventing the zipper from opening when the bag 10 is inflated.

The adjustment layer 121 (FIG. 1C) can comprise adjustable zones 123, 125 and 127 (not seen) shaped and located similarly to the adjustable zones 103, 105 and 107, and which can be adjusted before the bag 10 is in use.

Figure 11A:
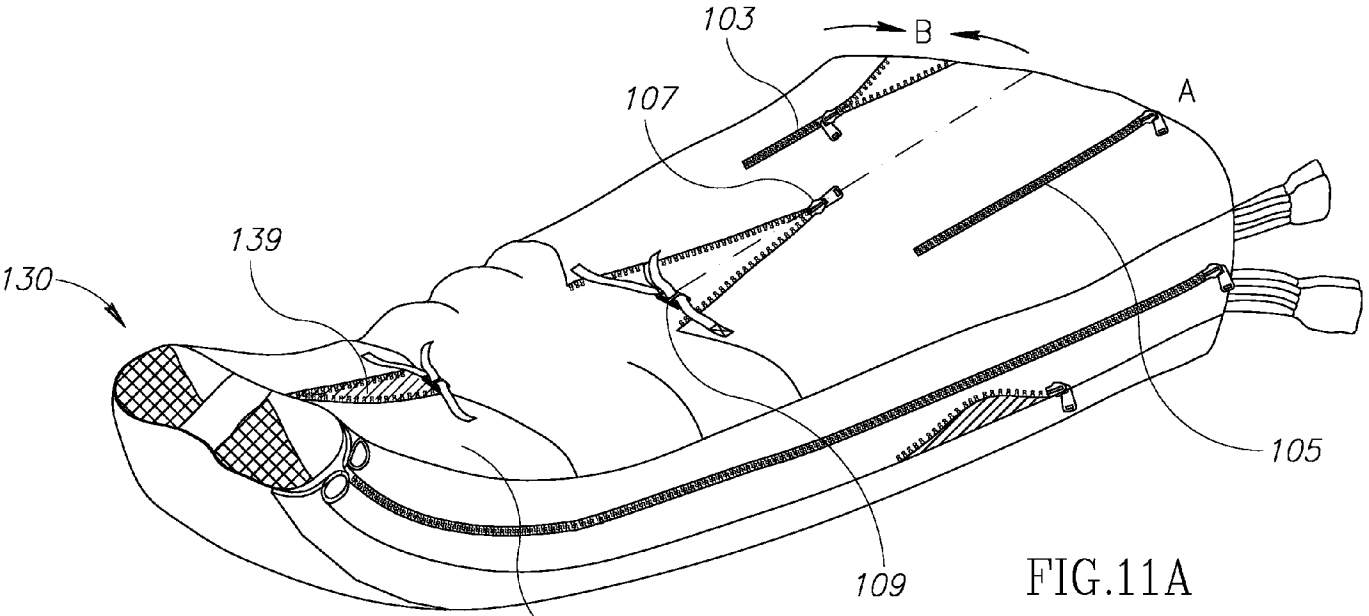
FIG. 11A is a schematic view of the compression bag shown in FIG. 1A, with two zippers in its adjustment layer being at least partially closed.
Figure 11C:
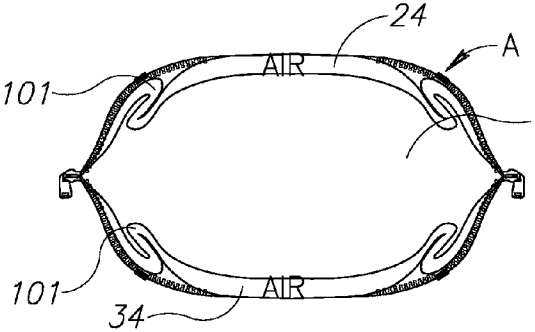
FIGS. 11B and 11C are schematic views of one cell of the bag shown in FIGS. 1A and 11A at the location of the zippers.
Figure 11B:
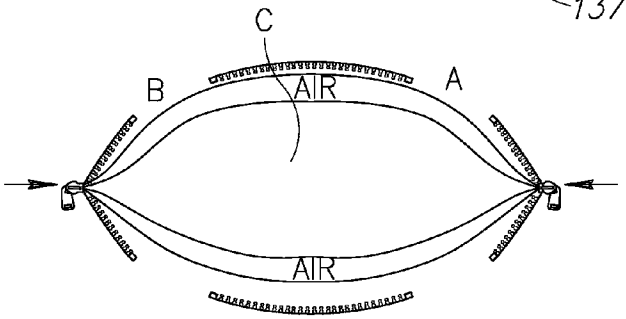

FIGS. 11B and 11C show one of the cells $C_1$ to $C_N$ extending under the area of the adjustable zones 103 and 105, in a position where the adjustable zones are open, and in the position where the adjustable zones 103 and 105 are at least partially closed. The material and the structure of the cells, and particularly the stretchable partitions forming two of their walls allow folds 110 to be created within the intermediate layers 24 and 34, when the cells are inflated, thereby allowing with the passage of air along the cell, i.e., without preventing fluid communication between the pressure source to the cell during the inflation.

With reference to FIGS. 1A, 1B and 11A, the bag 10 further comprises a feet area 130 at its lower portion 13, including the lower end 14 of the bag, which area is raised relative to the remainder of the lower portion 13 and has a length l along the longitudinal axis of the $A_1$ of the bag.

Figure 12:
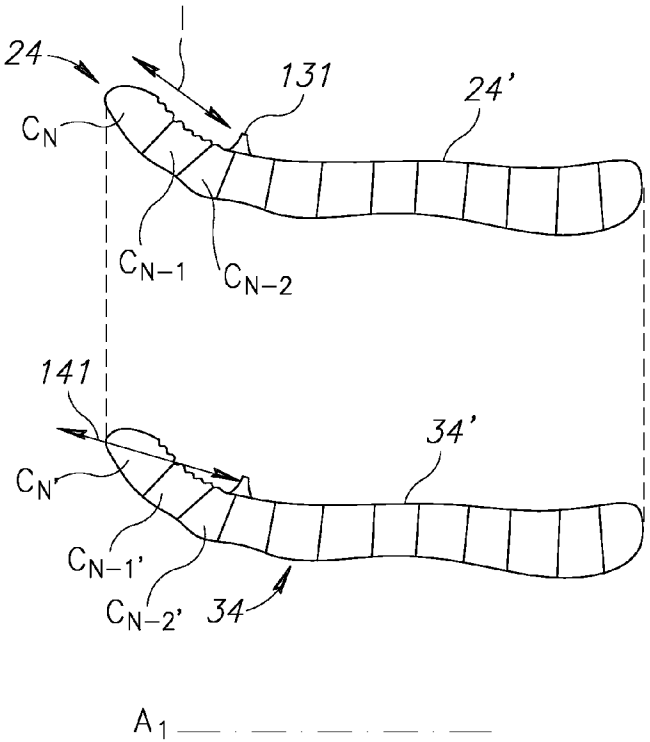
FIG. 12 is a schematic presentation of cross-sectional view of inflatable layers of the front and back parts of the compression bag shown in FIG. 4.

With reference to FIG. 12, the feet area 120 is obtained by means of folds 131 and 141 formed in the upper sub-layers 24' and 34' of the inflatable intermediate layers 24 and 34, respectively, each fold 131, 141 being spaced from the lower end 14 of the bag to the length l.

To obtain the folds 131 and 141 and thereby the feet area 130, two portions of each of the upper sub-layers 24', 34' that are located on two sides of the location where the fold is to be formed, e.g., portions of the upper sub-layer 24' covering the cells $C_{N-1}$ and $C_{N-2}$ and portions of the upper sub-layer 34' covering the cells $C_{N-1}'$ and $C_{N-2}'$, as shown in FIG. 12, are attached to each other along the entire width of the bag (i.e., along the axis $A_2$). The attachment of the above portions of the upper sub-layers one to the other may be made by sewing, welding, or the like. The feet area 130 may further comprise an adjustment layer 137 with an adjustable zone 139, similar to the adjustable zones 13, 15 and 107 in the adjustment layer 101 described above (1A, 1B, 3 and 11A).

Figure 13A:
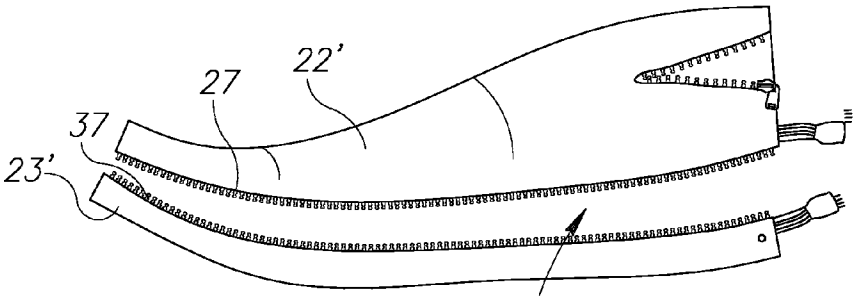
FIG. 13A shows a schematic view of the compression bag shown in FIGS. 1A and 1B, with its side zipper open.
Figure 13B:
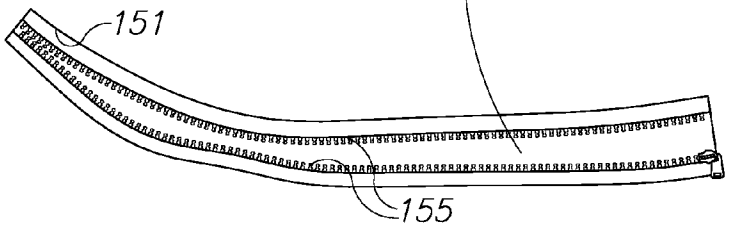
FIGS. 13B and 13C are schematic views of two examples of side inserts for use in the compression bag shown in FIG. 13A.
Figure 13C:
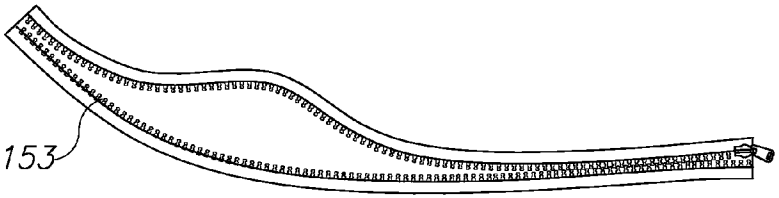

The bag 10 can further comprise adjustment side inserts, such as, for example, inserts 151 and 153, as shown in FIGS. 13B and 13C. The adjustment side inserts are configured for the insertion between the right edges 27 and 37 and the left edges 29 and 39 (not seen) of the front 21 and back 31 parts of the bag 10, and they have fastening means 155 which can be of the same kind as the closure means 41 of the bag 10 and can be configured for detachable engagement therewith, increasing thereby the distance between the right edges 27 and 37 and the left edges 29 and 39 and fitting the size of the bag 10 to a patient.

As seen, the adjustment side inserts have a length corresponding to that of the bag and they can have a uniform height along their entire length, such as the insert 151, or can vary in height, e.g., have an area of local widening such as in the insert 153, allowing to suit the width of the bag to local peculiarities of the patient's body.

As mentioned above, the bag 10 is configured to apply pressure to the body of a patient P by inflating and deflating the bag's cells according to a predetermined protocol, which can be any protocol known per se for the treatment of such diseases as of lymphatic/circulatory disorders and deep vein thrombosis prophylaxis.

In order to start the treatment, a patient has to be located within the bag, and in as close fitting as possible should be provided of the bag's geometry to the patient's body. There are three main stages by which this can be done, when the bag is first used by the patient, namely, a pre-adjustment preparatory stage, a final preparatory stage and a final adjustment stage, as described in detail below with reference to FIGS. 14A to 14D.

At the pre-adjustment preparatory stage relevant dimensions of the patient P, such as the length of the legs, circumference of the patient's body at different locations thereof, etc., are measured and, if necessary, the adjustable zones 123, 125 and 127 of the adjustment layer 121 of the back part 31 of the bag are partially or completely closed, if needed. In addition, if so required, the adjustment side inserts such as the insert 151 or 153, are attached to the right and left sides of the bag 10. Alternatively, the side inserts may be added at a later stage. Based on the length of the patient's legs, a decision is made on the desired length L of the separating insert arrangement 51.

Figure 14A:
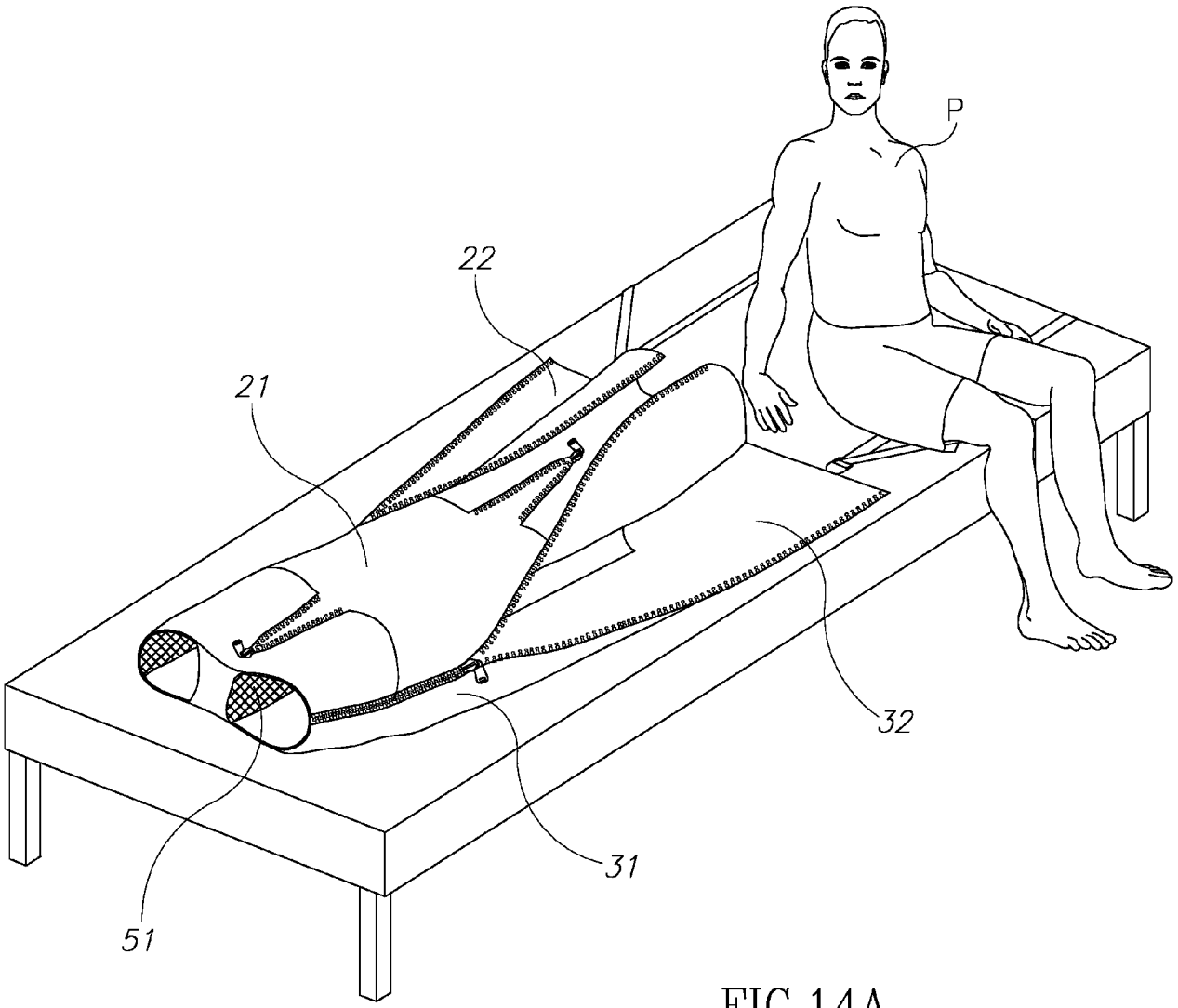
FIGS. 14A to 14E are schematic illustrations of different stages of the application of the compression bag shown in FIG. 1B, to a user (for illustration purposes only the compression bag is shown with its lower part inflated, though in use the entire bag is deflated during the above stages)

Before and during the performance of the above pre-adjustment preparatory stage, the front part 21 of the bag 10 can be completely separated from the back part 31, or can be attached to the back part at least along the feet area 130 and a part of the lower portion 13 of the bag 10 adjacent thereto, as shown in FIG. 14A, if in its initial state, the bag already had its separating insert arrangement 51 of a suitable length installed.

At the final preparatory stage, the separating insert 51 is installed, and if its desired length is shorter than the maximal length of the insert, the installation is made without the detachable member 83, i.e., only the ridges 53 and 53' of the separating insert arrangement 51 are installed. If the bag in its initial state had the detachable member 83 installed, at this stage the member 83 is removed. If the front part 21 has not yet been attached to the back part at the lowermost area of the lower portion 13 of the bag, this is then done at this stage and the tubes 93 and 93' connected to the inlets 91 and 91' of the cells $I_M$ to $I_N$ and $I_M'$ to $I_N'$ of the ridges 53 and 53' are then connected to the corresponding outlets 69 and 69' of the cells $C_M$ to $C_N$ and $C_M'$ to $C_N'$ of the respective front and back parts 21 and 31 of the bag 10. In addition, if the desired length of the separating insert 51 is shorter than the length of its ridges 53 and 53', the ridges are installed with their cells that are not to be inflated, folded (not shown). Normally, the latter cells would be those that are furthest from the lower end 14 of the bag 10.

Figure 14B:
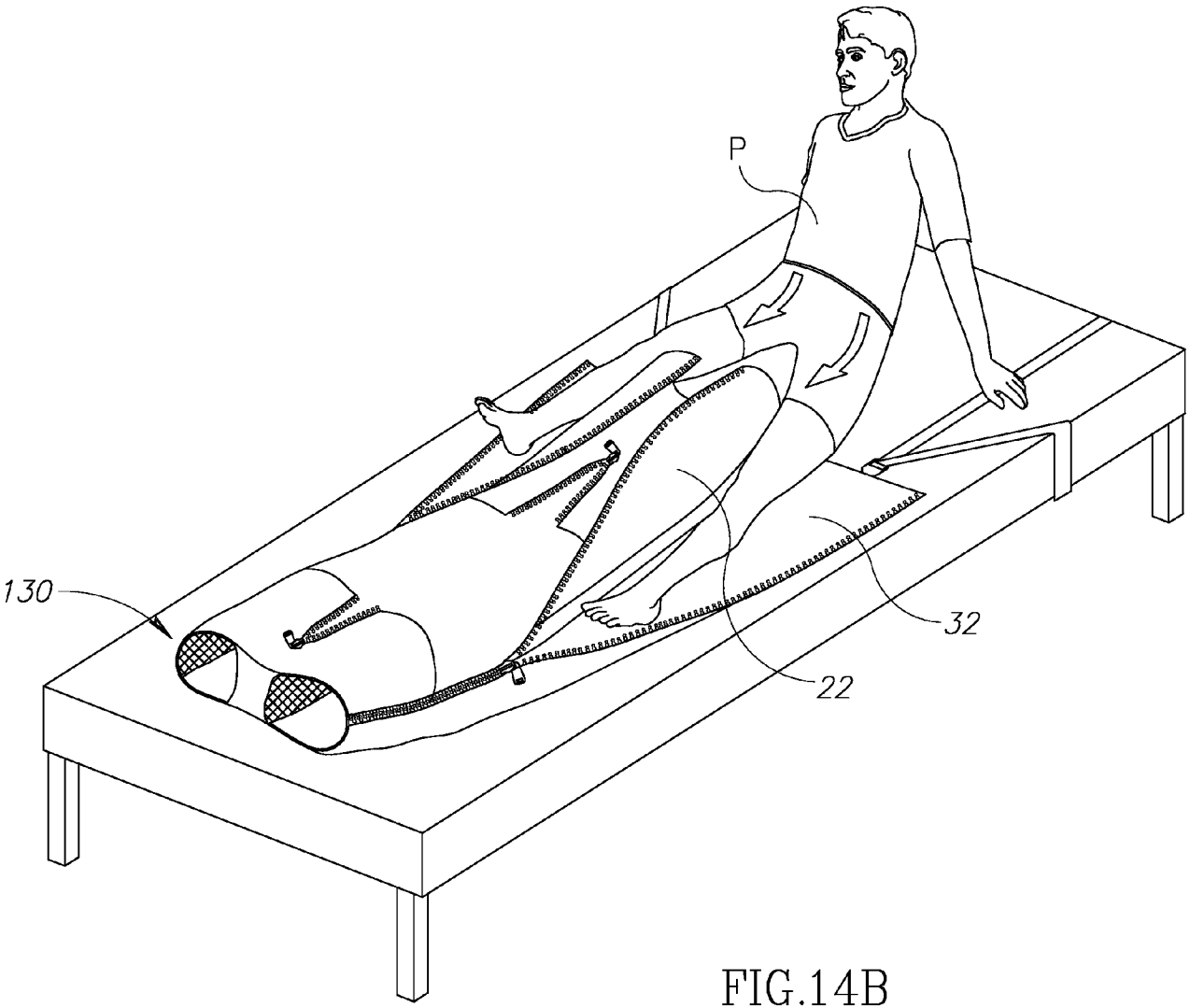

The final preparatory stage results in the bag 10 having therein pants and being opened at two sides thereon at least along the upper portion 11 of the bag 10, thus being ready for the patient to enter it as regular pants, as shown in FIG. 14B.

Figure 14C:
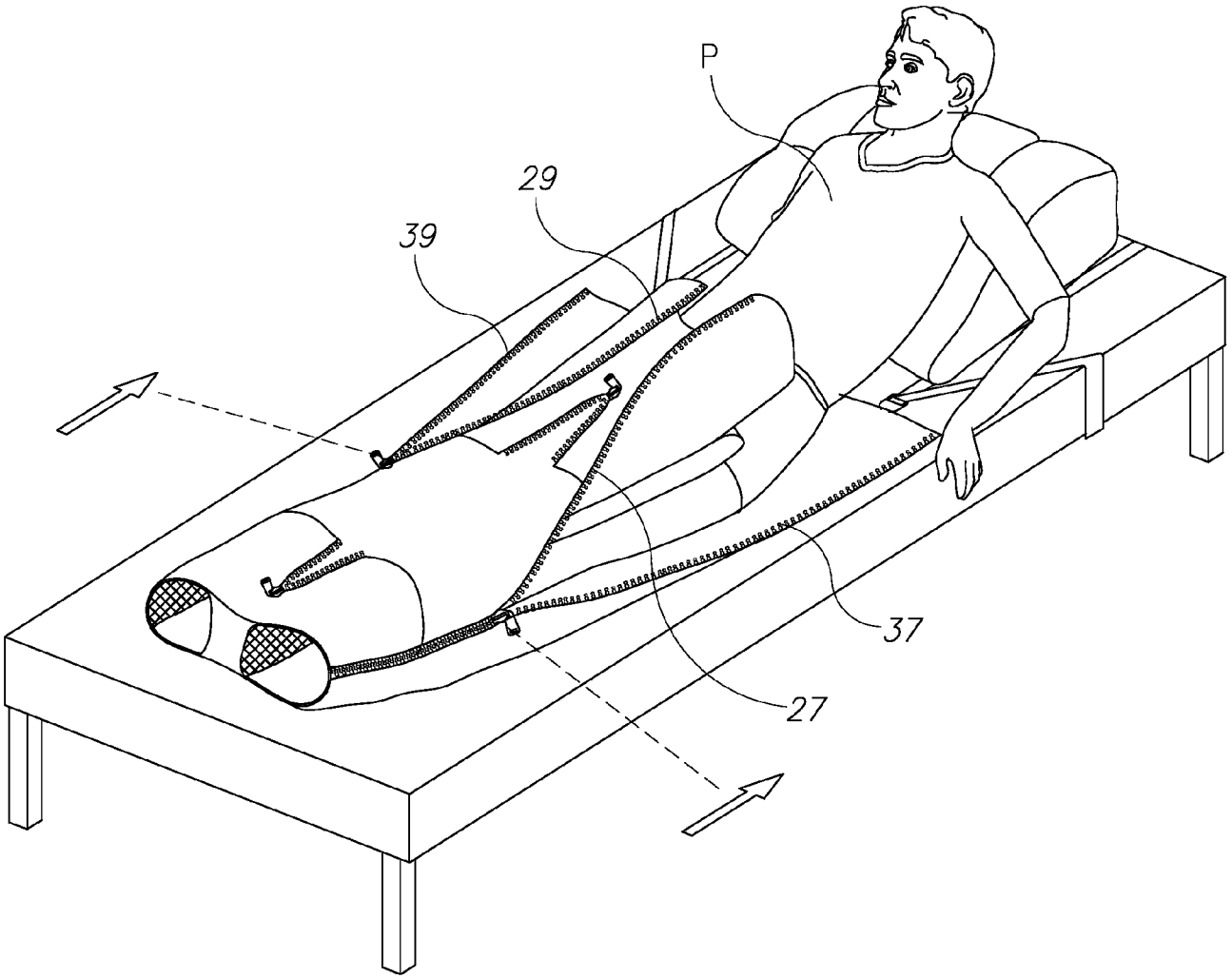

With reference to FIG. 14C, the final adjustment stage is performed with the patient having entered the bag 10, having the separating insert arrangement 51 between his/her legs and having his/her feet located at the feet area 130 of the bag 10. At this stage the position the ridges 51 and 51' can be displaced right or left to fit the actual position of the patient's legs, and the upper portion of the front part 21 of the bag 10, is arranged to cover the patient so as to allow the front part's complete attachment to the back part 31 by the closure means 41.

Figure 14D:
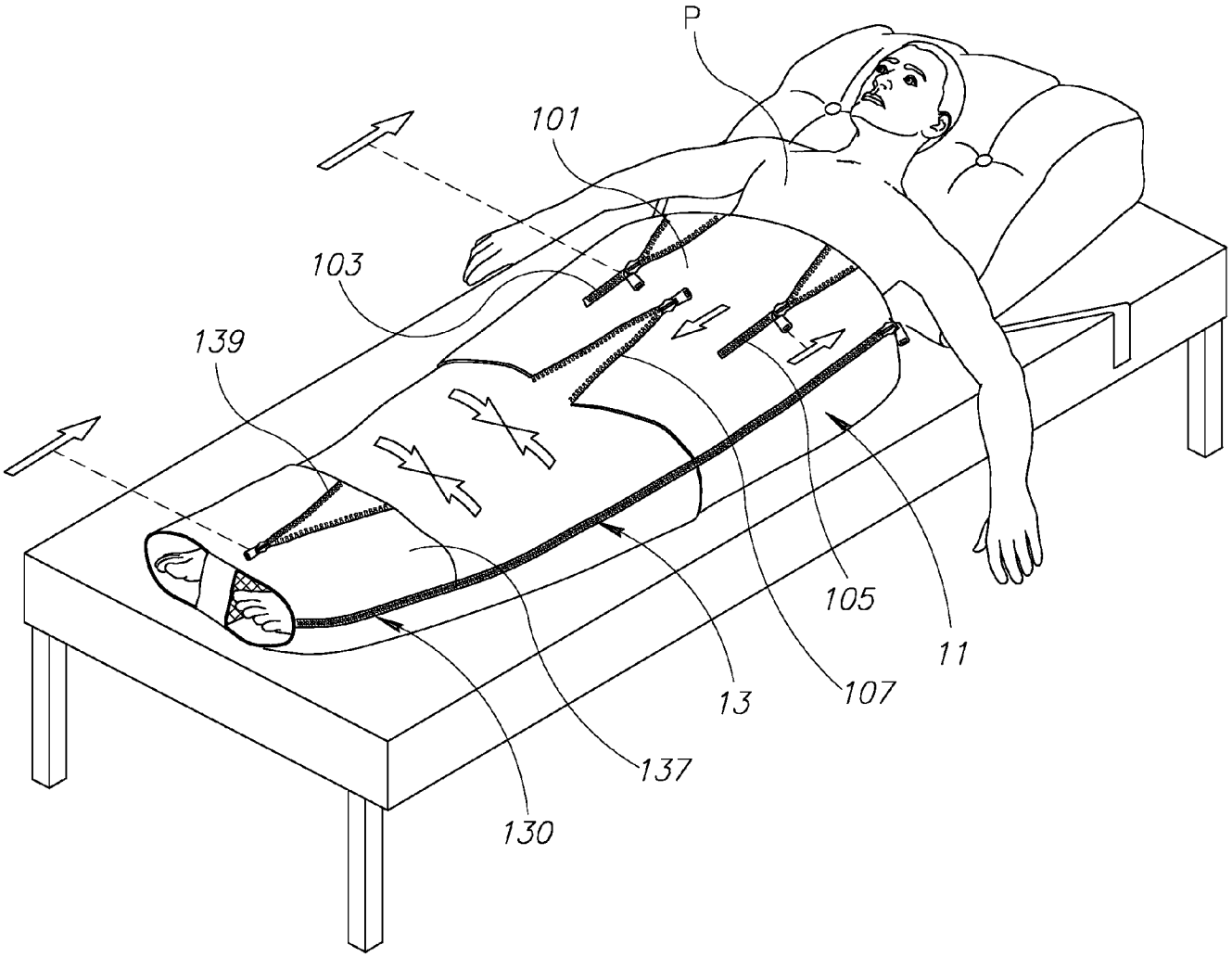

With reference to FIG. 14D, upon the patient being fully wrapped by the bag 10 so that the upper portion 11 of the bag accommodates the abdominal area of the patient's body and the lower portion 13 of the bag accommodates the patient's legs, final adjustment is performed, if necessary, using one or more of the adjustable zones 103, 105, 107 and 139, to achieve a more tight fit between the bag 10 and the patient P. The tightening strap 109 is then tightened.

The above procedures can be performed by the patient alone or with assistance of another person, if available, in which case the patient can lie down on the back part 31 of the bag after the pre-adjustment preparatory stage, and the assisting person to perform for him the remaining procedures.

Figure 14E:
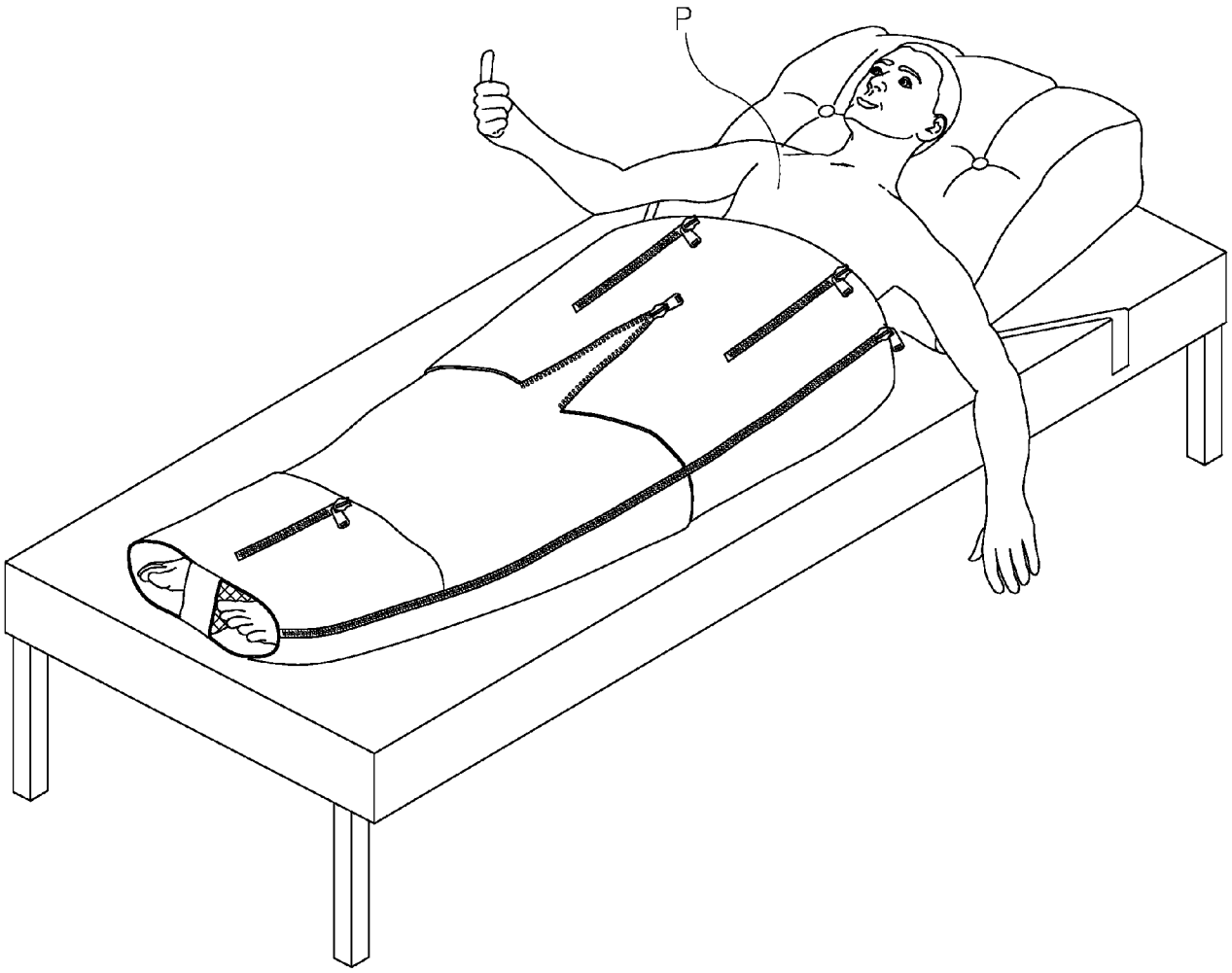
Figure 15B:
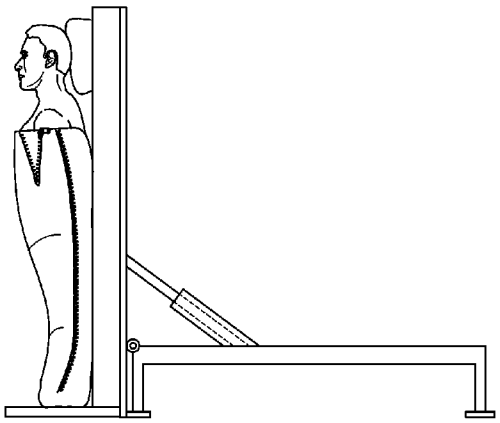
FIGS. 15A-15D are a schematic illustration of a patient entering the bag shown in any one of the preceding figures being in vertical position.
Figure 15D:
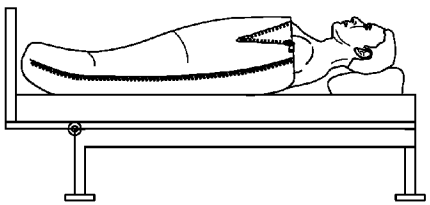
Figure 15A:
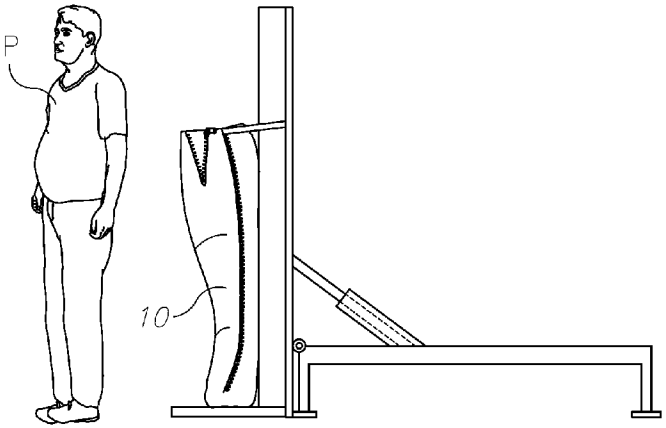
Figure 15C:
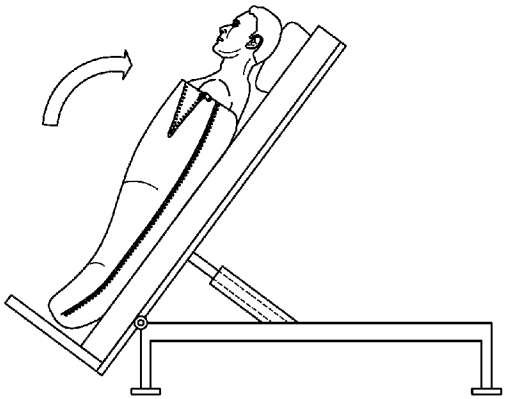

Moreover, it can be possible for a patient to enter the bag being in vertical position, in case the bag's back part 31 is attached to a special bed which can be moved between a vertical state and a horizontal state, as shown in FIGS. 15A-15D. This option can be advantageous for patients that are incapable of taking themselves a horizontal position. Once the bag 10 is closed and the patient is accommodated therein (FIG. 14E), the plugs 68 and 68' are connected to the pressure source (not shown) to allow the application of inflation-deflation cycles to the cells $C_1$ to $C_N$ and $C_1'$ to $C_N'$, and consequently the cells $I_M$ to $I_N$ and the cells $I_M'$ to $I_N'$, as desired.

In operation, the cells $C_1$ to $C_N$ and $C_1'$ to $C_N'$ when inflated increase their dimension in a direction perpendicular to the axes $A_1$ and $A_2$, as shown by arrows $D_1$ in FIG. 5 and thereby apply pressure to the corresponding parts of the front and the back of the patient including front and back regions of his legs. The cells $I_M$ to $I_N$ and $I_M'$ to $I_N'$ are inflated simultaneously with the cells $C_M$ to $C_N$ and $C_M'$ to $C_N'$ since they are in fluid communication, as detailed above, whereby their dimension is increased along the transverse axis $A_2$, as shown by arrows $D_2$, thereby applying pressure to the side regions of the legs of the patient.

The pressure source can be a compatible pneumatic compression therapy system control unit, such as, for example, Lympha Press Optimal™, produced by the Applicant or other compatible pneumatic compression therapy control units compressors used in the industry.

Those skilled in the art to which this invention pertains will readily appreciate that numerous changes, variations and modifications can be made without departing from the scope of the invention, mutatis mutandis.

The invention claimed is:

1. A compression bag comprising:

an upper portion for applying a pressure at least to the abdominal area of a patient; and a lower portion for applying a pressure to at least a part of the patient's legs, the lower portion including a back part, a front part, and a closure means configured for detachably attaching at least a portion of the front and back parts to each other;

a separating insert detachably attachable to at least one of the back part or the front part, the separating insert being configured to separate at least a portion of the lower portion into a left and a right region, thereby forming pants in said bag; and a plurality of inflatable cells in the back part, the front part, and the separating insert, the inflatable cells being sealingly separated from one another and configured to be selectively inflated and deflated in one or more inflation-deflation cycles for treating lymphedema.

2. A compression bag according to claim 1, wherein the separating insert is configured to be detachably attached to both the back part and the front part of the bag.

3. A compression bag according to claim 1, wherein at least one of the plurality of inflatable cells of the separating insert is configured for fluid communication with an adjacent one of the plurality of inflatable cells of the front part or the back part of the lower portion.

4. A compression bag according to claim 1, wherein a first portion of the inflatable cells of the separating insert are configured for fluid communication with a second portion of the inflatable cells of the back part and a third portion of the inflatable cells of the front part.

5. A compression bag according to claim 1, wherein a longitudinal edge of the front part is attachable to a longitudinal edge of the back part by the closure means.

6. A compression bag according to claim 1, wherein the bag has a length adapted to be substantially parallel to a height of a patient's body and a width substantially perpendicular to the length of the bag, and wherein a first portion of the inflatable cells in the front part and the back part extend along the entire width of the bag.

7. A compression bag according to claim 6, wherein second portion of the inflatable cells of the separating insert are alignable with the first portion of the inflatable cells in the front part and the back part.

8. A compression bag according to claim 1, wherein each of the front part and the back part is in the form of a sheet and includes an inflatable layer with an inner sub-layer, an outer sub-layer, and partitions extending between the inner sub-layer and the outer sub-layer, the partitions separating two or more of the inflatable cells from one another.

9. A compression bag according to claim 8, wherein the separating insert is in the form of at least one ridge having right and left walls which, when the insert is attached to at least one of the front and back parts, are oriented transversely to the inflatable layers of the front and back parts of the bag.

10. A compression bag according claim 1, wherein each of the back and front parts of the bag has left and right side edges, the closure means being configured for detachably attaching the side edges of the front part and the back part to each other.

11. A bag for compression therapy, the bag comprising:

an upper portion for applying a pressure at least to the abdominal area of a patient; and a lower portion for applying a pressure to at least a part of the patient's legs, at least one of the lower portion or the upper portion comprising: a back part and a front part, each having; an inflatable layer comprising an upper sub-layer, a lower sub-layer, and a plurality of selectively inflatable cells located between the upper sub-layer and the lower sub-layer, the inflatable cells being sealingly separated from each other by one or more partitions extending between the upper sub-layer and the lower sub-layer; and a plurality of folds within the upper sub-layer of the back part, the plurality of folds being configured to form a feet area of the bag.

12. A compression bag having an upper portion for applying a pressure at least to the abdominal area of a patient and a lower portion for applying a pressure to at least a part of the patient's legs, at least one of the upper portion or the lower portion comprising a back part, a front part, and a closure means configured for detachably attaching the front part and the back part to each other; each of the front and back parts being in the form of a sheet and having an inflatable layer with inflatable cells sealingly separated from each other, and a covering layer with a plurality of spaced apart adjustable regions, each of the plurality of spaced apart adjustable regions being configured to change its state between an extended state in which the adjustable region exhibits a first width, and a folded state in which the adjustable region exhibits a second width that is less than the first width, and wherein at least one of the plurality of spaced apart adjustable regions includes a fastener configured to selectively keep said at least one of the plurality of spaced apart adjustable regions in the folded state by attaching two or more portions of said at least one of the plurality of spaced apart adjustable regions together.

13. A method of preparation of a patient to a compression therapy to be performed by means of a compression bag having an upper portion for applying a pressure at least to the abdominal area of a patient, and a lower portion for applying a pressure to at least a part of the patient's legs, at least the lower portion comprising:

a back part, a front part, and a closure means configured for selectively attaching the back part to the front part;

a separating insert detachably attachable to at least one of the back part or the front part, the separating insert being configured to separate at least a portion of the lower portion into a left region and a right region;

a plurality of inflatable cells in the back part, the front part, and the separating insert, the inflatable cells being sealingly separated from adjacent ones of the inflatable cells; the method comprising:

(a) separating said front part from said back part at least at the upper portion, to allow accommodation of the patient in the back part of the bag;

(b) accommodating the patient that exhibits lymphedema in the bag;

(c) attaching said insert to at least one of the back part or the front part of the lower portion, the insert being configured to separate at least a portion of the lower portion into a left region and a right region;

(d) detachably attaching said front and back parts to each other by means of said closure means, to have the bag closed along its lower and upper portions; and (e) selectively inflating and deflating one or more of the inflatable cells in one or more inflation-deflation cycles for treating lymphedema of the patient accommodated in the bag.

14. A method according to claim 13, further comprising adjusting a length of the separating insert.

15. A method according to claim 13, wherein the bag further comprises: an inflatable layer in each of the front and back parts, comprising an upper sub-layer, a lower sub-layer, and a plurality of folds at the upper sub-layer of each of said front and back parts of the bag, formed along the entire width thereof and causing the lower end of the bag to be raised relative to the remainder of the lower portion of the bag, when the front and back parts are attached to each other by said closure means, forming thereby a feet area of the bag.

16. A method according to claim 15, further comprising accommodating the patient within the bag so that the patient's feet are received within the feet area of the bag.

17. A method according to claim 13, wherein each of the front part and the back part in the form of a sheet and includes an inflatable layer with the inflatable cells sealingly separated from each other, and a covering layer with a plurality of spaced apart adjustable region, each adjustable region configured to change its state between an extended state in which the adjustable region exhibits a first width, and a folded state in which the adjustable region exhibits a second width that is less than the first width.

18. A method according to claim 17, further comprising adjusting the adjustable region between extended state and the folded state by means of a fastener.

19. A method according to claim 13, further comprising detachably attaching the insert to both the back part and the front part of the bag.

20. A method according to claim 13, further comprising attaching the front and the back parts to each other along their longitudinal edges where the closure means are located.

* * * * *